US008038931B1

(12) United States Patent
Thomas et al.

(10) Patent No.: US 8,038,931 B1
(45) Date of Patent: Oct. 18, 2011

(54) ON-SITE INDUCTION HEATING APPARATUS

(75) Inventors: Jeffrey R. Thomas, Appleton, WI (US); Randall G. Baxter, Black Creek, WI (US); Mark A. Ulrich, New London, WI (US); Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 1094 days.

(21) Appl. No.: 09/995,037

(22) Filed: Nov. 26, 2001

(51) Int. Cl.
*H05B 6/06* (2006.01)
*H05B 6/40* (2006.01)

(52) U.S. Cl. ..... 266/96; 266/97; 266/98; 219/632; 219/677

(58) Field of Classification Search ..... 219/632, 219/677; 266/96, 97, 98
See application file for complete search history.

(56) References Cited

U.S. PATENT DOCUMENTS

| | | | | | |
|---|---|---|---|---|---|
| 2,359,058 | A | * | 9/1944 | Somes | 266/78 |
| 2,457,843 | A | | 1/1949 | Strickland, Jr. | 174/47 |
| 2,483,301 | A | | 9/1949 | Roberds | 174/15 |
| 2,817,066 | A | | 12/1957 | Scarpa | 336/84 |
| 2,988,804 | A | | 6/1961 | Tibbetts | 29/155.57 |
| 3,022,368 | A | | 2/1962 | Miller | 174/15 |
| 3,403,240 | A | * | 9/1968 | Henderson et al. | 219/632 |
| 3,492,453 | A | | 1/1970 | Hurst | 219/10.49 |
| 3,535,597 | A | | 10/1970 | Kendrick | 317/155.5 |
| 3,764,725 | A | | 10/1973 | Kafka | 174/15 |
| 3,946,349 | A | | 3/1976 | Haldeman, III | 336/62 |
| 4,058,696 | A | * | 11/1977 | Antier et al. | 219/668 |
| 4,317,979 | A | | 3/1982 | Frank et al. | 219/10.77 |
| 4,339,645 | A | | 7/1982 | Miller | 219/10.49 |
| 4,355,222 | A | | 10/1982 | Geithman et al. | 219/10.57 |
| 4,392,040 | A | | 7/1983 | Rand et al. | 219/10.71 |
| 4,527,032 | A | | 7/1985 | Young et al. | 219/10.61 |
| 4,527,550 | A | | 7/1985 | Ruggera et al. | 128/1.5 |
| 4,549,056 | A | | 10/1985 | Okatsuka et al. | 219/10.77 |
| 4,578,552 | A | | 3/1986 | Mortimer | 219/10.41 |
| 4,761,528 | A | | 8/1988 | Caillaut et al. | 219/10.491 |
| 4,794,220 | A | | 12/1988 | Sekiya | 219/10.491 |
| 4,900,885 | A | | 2/1990 | Inumada | 219/10.55 B |
| 4,942,279 | A | | 7/1990 | Ikeda | 219/10.75 |
| 4,963,694 | A | | 10/1990 | Alexion et al. | 174/15.6 |
| 4,975,672 | A | | 12/1990 | McLyman | 336/198 |
| 5,004,865 | A | | 4/1991 | Krupnicki | 174/15.7 |
| 5,101,086 | A | | 3/1992 | Dion et al. | 219/10.491 |
| 5,113,049 | A | | 5/1992 | Border et al. | 219/10.79 |
| 5,185,513 | A | | 2/1993 | Pacileo | 219/497 |
| 5,198,053 | A | * | 3/1993 | Duncan | 156/64 |
| 5,313,037 | A | | 5/1994 | Hansen et al. | 219/632 |
| 5,343,023 | A | | 8/1994 | Geissler | 219/661 |
| 5,430,274 | A | * | 7/1995 | Couffet et al. | 219/677 |
| 5,461,215 | A | | 10/1995 | Haldeman | 219/677 |
| 5,504,309 | A | | 4/1996 | Geissler | 219/663 |
| 5,708,253 | A | | 1/1998 | Bloch et al. | 219/130.01 |
| 5,874,713 | A | * | 2/1999 | Cydzik et al. | 219/633 |
| 6,043,471 | A | | 3/2000 | Wiseman et al. | 219/662 |

(Continued)

*Primary Examiner* — Sikyin Ip
(74) *Attorney, Agent, or Firm* — Fletcher Yoder

(57) ABSTRACT

A method and apparatus for heating a workpiece. An induction heating system is used to induce magnetic fields in a workpiece to inductively heat the workpiece. The induction heating system may comprise a portable power source, a portable power source controller, a fluid-cooled induction heating cable, and a portable cooling unit. The induction heating system may be used to perform a variety of induction heating operations, including: annealing, surface hardening, heat treating, stress-relieving, curing, shrink-fitting, etc.

6 Claims, 21 Drawing Sheets

U.S. PATENT DOCUMENTS

| | | | | |
|---|---|---|---|---|
| 6,124,581 | A | 9/2000 | Ulrich | 219/665 |
| 6,229,126 | B1 | 5/2001 | Ulrich et al. | 219/635 |
| 6,265,701 | B1 | 7/2001 | Bickel et al. | 219/617 |
| 6,316,755 | B1 | 11/2001 | Ulrich | 219/665 |
| 6,346,690 | B1 | 2/2002 | Ulrich et al. | 219/635 |
| 6,727,483 | B2 * | 4/2004 | Thomas et al. | 219/632 |
| 7,015,439 | B1 * | 3/2006 | Thomas et al. | 219/667 |
| 2003/0038130 | A1 * | 2/2003 | Thomas et al. | 219/632 |

* cited by examiner

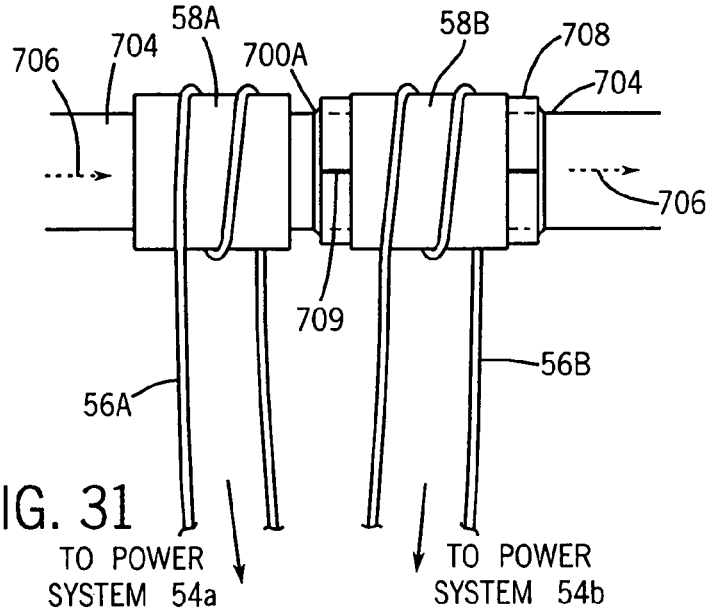
FIG. 31
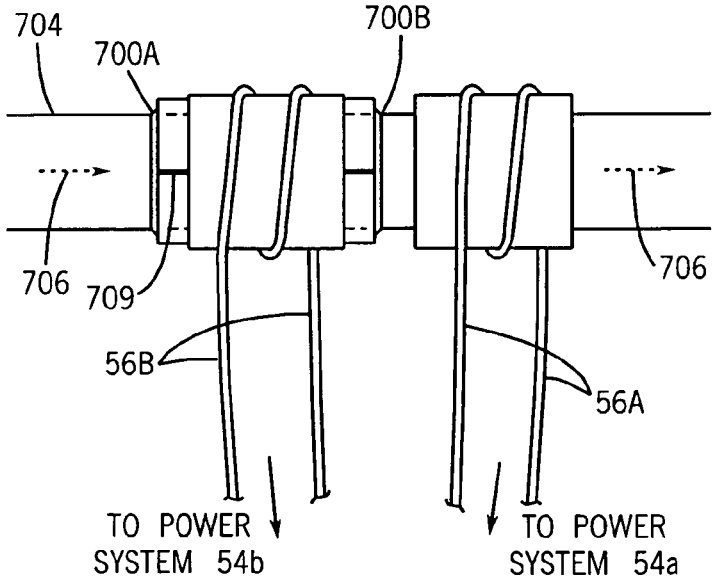
FIG. 32
FIG. 34
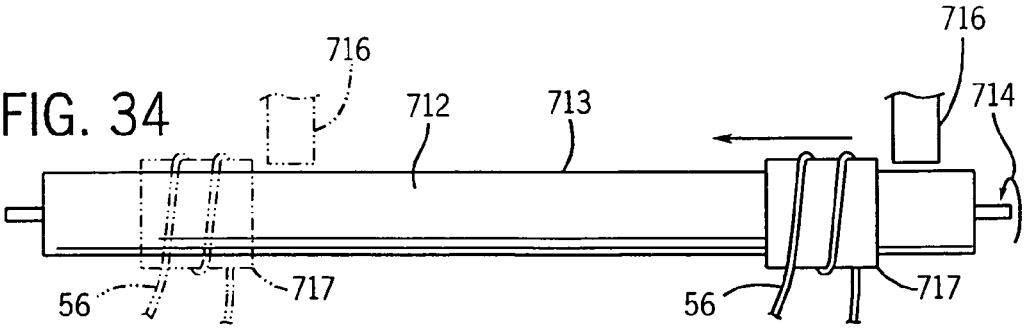

ON-SITE INDUCTION HEATING APPARATUS

FIELD OF THE INVENTION

The present invention relates generally to induction heating, and particularly to a method and apparatus for inductively heating a workpiece using an induction heating system located at a worksite.

BACKGROUND OF THE INVENTION

Induction heating is a method of heating a workpiece. Induction heating involves applying an AC electric signal to a conductor adapted to produce a magnetic field, such as a loop or coil. The alternating current in the conductor produces a varying magnetic flux. The conductor is placed near a metallic object to be heated so that the magnetic field passes through the object. Electrical currents are induced in the metal by the magnetic flux. The metal is heated by the flow of electricity induced in the metal by the magnetic field.

Systems that have been developed for performing induction heating on location at a worksite have suffered from a number of limitations. For example, air-cooled systems have a temperature limit above which damage may occur to the system. Damage may occur from the flow of electricity through the induction heater and from the temperature of the workpiece during induction heating.

There is a need therefore for an induction heating system that avoids the problems associated with current on-site induction heating systems. Specifically, there is a need for an induction heating system that enables large amounts of current to flow through an induction heater and high temperatures to be achieved in a workpiece without damaging the induction heating cable.

SUMMARY OF THE INVENTION

The present technique provides novel inductive heating components, systems, and methods designed to respond to such needs. According to one aspect of the present technique, an induction heating system is provided. The induction heating system is used to induce magnetic fields in a workpiece to heat the workpiece. The induction heating system comprises a portable power source and a portable fluid cooling unit. A power source controller may be used to control power from the power source to an induction heating cable coupleable to the portable power source.

The induction heating system may be programmed and physically arranged to perform a myriad of induction heating operations. For example, the induction heating system may be programmed to maintain or change the temperature of the workpiece in accordance with a desired temperature profile. For example, the power source controller may be programmed to direct the application of power to the workpiece to pre-heat the workpiece prior to welding and to post-weld heat the workpiece to relieve stress in the weld. In addition, the power source controller is operable to maintain the temperature of a workpiece or to change the temperature of a workpiece at desired rates of temperature change, during both raising and lowering the temperature of the workpiece.

The induction heating system also may be operable to perform induction heating operations to repair damaged pipes, such as pipelines, without having to secure fluid flow through the pipe. The system also may be operable to inductively heat a workpiece to cure a layer of epoxy deposited on the workpiece. The system also may be operable to assist in preparing a shaft for polishing by inductively heating the shaft prior to polishing to warm a polishing compound disposed on the shaft. The system also may be operable to shrink fit two workpieces together by inductively heating one of the workpieces to expand to enable the second workpiece to be inserted into the first workpiece. The system also may be operable to perform surface hardening and annealing of workpieces.

BRIEF DESCRIPTION OF THE DRAWINGS

The invention will hereafter be described with reference to the accompanying drawings, wherein like reference numerals denote like elements, and:

FIGS. 30-32 are elevational views illustrating the repair of a damaged pipeline using a portable induction heating system to inductively heat a repair member and a portion of the pipeline, according to an exemplary embodiment of the present invention;

FIG. 34 is an elevational view illustrating the use of a portable induction heating system to heat a shaft prior to polishing the shaft with a polishing compound, according to an exemplary embodiment of the present invention.

DETAILED DESCRIPTION OF THE PREFERRED EMBODIMENTS

Figure 1:
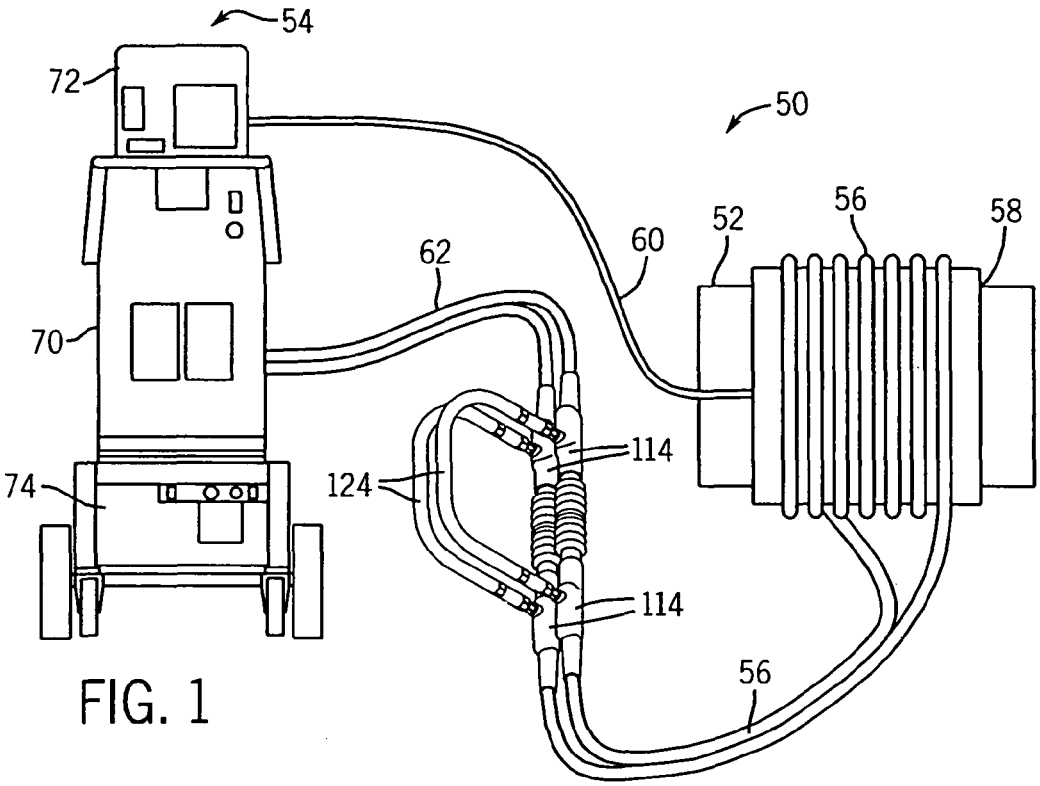
FIG. 1 is an induction heating system, according to an exemplary embodiment of the present technique.

Referring generally to FIGS. 1-5, a portable induction heating system 50 for applying heat to a workpiece 52 is illustrated. In the illustrated embodiment, the workpiece 52 is a circular pipe. As best illustrated in FIG. 1, the induction heating system 50 comprises a power system 54, a fluid-cooled induction heating cable 56, an insulation blanket 58, and at least one temperature feedback device 60. The power system 54 produces a flow of AC current through the fluid-cooled induction heating cable 56. Additionally, the power system provides a flow of cooling fluid through the fluid-cooled induction heating cable 56. In FIG. 1, the fluid-cooled induction heating cable 56 has been wrapped around the workpiece 52 several times to form a series of loops. An extension cable 62 is used to extend the effective distance of the fluid-cooled induction heating cable 56 from the power system 54. In the illustrated embodiment, the extension cable 62 couples the fluid-cooled induction heating cable 56 to the power system 54 both electrically and fluidicly.

Figure 2:
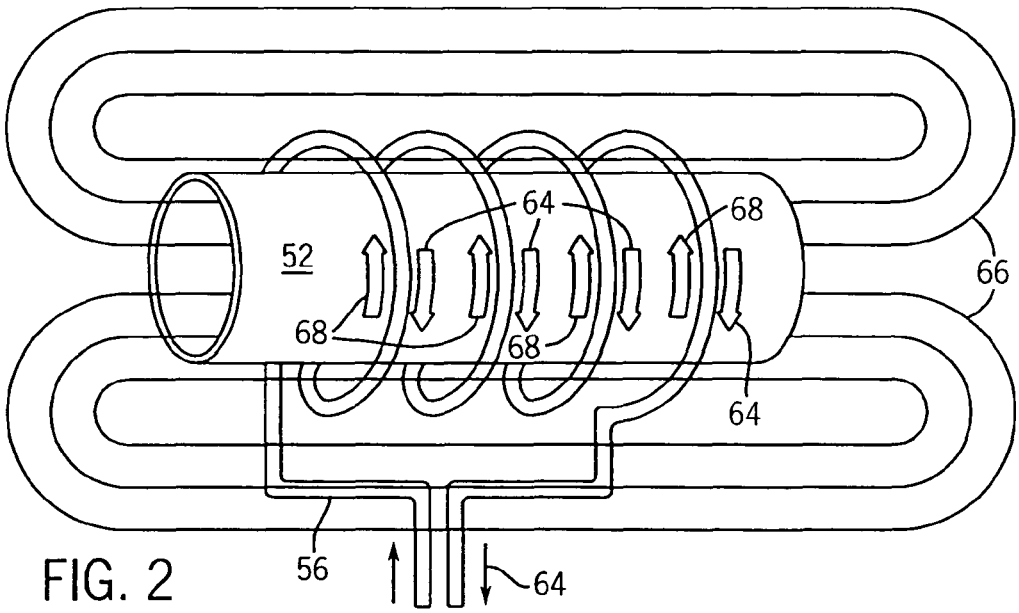
FIG. 2 is a diagram of the process of inducing heat in a workpiece using an induction heating system, according to an exemplary embodiment of the present technique.

As best illustrated in FIG. 2, the AC current 64 flowing through the fluid-cooled induction heating cable 56 produces a magnetic field 66. The magnetic field 66, in turn, induces a flow of current 68 in the workpiece 52. The induced current 68 produces heat in the workpiece 52. Referring again to FIG. 1, the insulation blanket 58 forms a barrier to reduce the loss of heat from the workpiece 56 and to protect the fluid-cooled induction heating cable 56 from heat damage. The fluid flowing through the fluid-cooled induction heating cable 56 also acts to protect the fluid-cooled induction heating cable 56 from heat damage due to the temperature of the workpiece 52 and electrical current flowing through the conductors in the fluid-cooled induction heating cable. The temperature feedback device 60 provides the power system 54 with temperature information from the workpiece 52.

The illustrated induction heating system enables the system to be transported to a worksite or operated within a shop. The induction heating system can be used for a number of industrial heating applications, such as relieving stress in a workpiece, surface hardening, annealing, etc. The power system 54 comprises a power source 70, a controller 72, and a cooling unit 74 mounted on a wheeled cart 75. The power source 70 produces the AC current that flows through the fluid-cooled induction heating cable 56. The controller 72 is programmable and is operable to control the operation of the power source 70. In the illustrated embodiment, the controller 72 controls the operation of the power source 70 in response to programming instructions and the workpiece temperature information received from the temperature feedback device 60. The cooling unit 74 is operable to provide a flow of cooling fluid through the fluid-cooled induction heating cable 56 to remove heat from the fluid-cooled induction heating cable 56.

Figure 3:
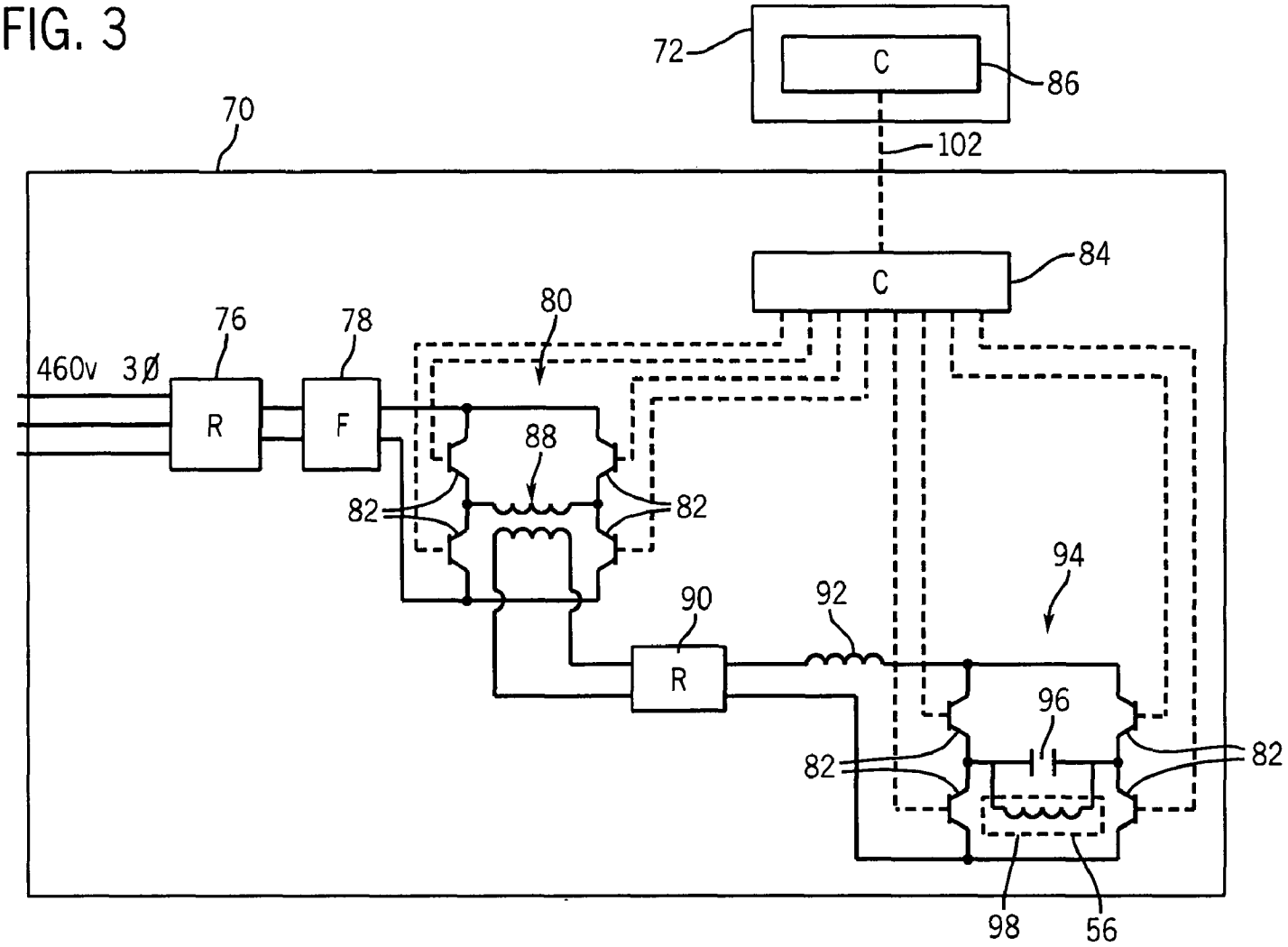
FIG. 3 is an electrical schematic diagram of an induction heating system, according to an exemplary embodiment of the present technique.

Referring generally to FIG. 3, an electrical schematic of a portion of the system 50 is illustrated. In the illustrated embodiment, 460 Volt, 3-phase AC input power is coupled to the power source 70. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBTs. Additionally, in the illustrated embodiment, a controller board 84 housed within the power source 70 controls the electronic switches 82. Control circuitry 86 within the controller 72 in turn, controls the controller board 84.

A step-up transformer 88 is used to couple the AC output from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 converts the DC output into high-frequency AC signals. A capacitor 96 is coupled in parallel with the fluid-cooled induction heating cable 56 across the output of the second inverter circuit 94. The fluid-cooled induction heating cable 56, represented schematically as an inductor 98, and capacitor 96 form a resonant tank circuit. The capacitance and inductance of the resonant tank circuit establishes the frequency of the AC current flowing through the fluid-cooled induction heating cable 56. The inductance of the fluid-cooled induction heating cable 56 is influenced by the number of turns of the heating cable 56 around the workpiece 52. The current flowing through the fluid-cooled induction heating cable 56 produces a magnetic field that induces current flow, and thus heat, in the workpiece 52.

Figure 4:
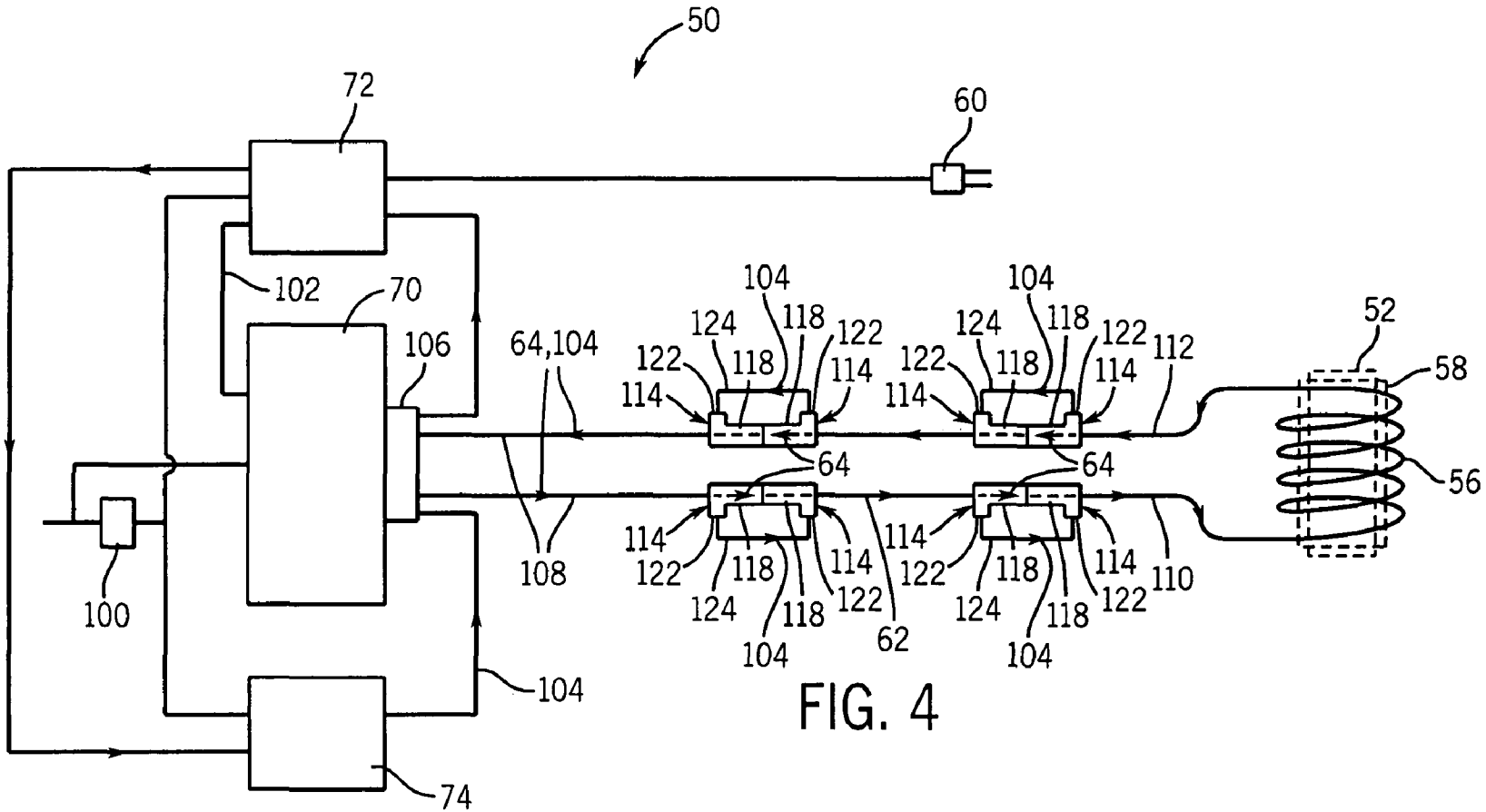
FIG. 4 is a schematic diagram of a system for inductively heating a workpiece, according to an exemplary embodiment of the present technique.

Referring generally to FIG. 4, an electrical and fluid schematic of the induction heating system 50 is illustrated. In the illustrated embodiment, 460 Volt, 3-phase AC input power is supplied to the power source 70 and to a step-down transformer 100. In the illustrated embodiment, the step-down transformer 100 produces a 115 Volt output applied to the fluid cooling unit 74 and to the controller 72. The step-down transformer 100 may be housed separately or within one of the other components of the system 50, such as the fluid cooling unit 74 or wheeled-cart 75. A control cable 102 is used to electrically couple the controller 72 and the power source 70. As discussed above, the power source 70 provides a high-frequency AC power output, such as radio frequency AC signals, to the heating cable 56. In the illustrated embodiment, cooling fluid 104 from the cooling unit 74 flows to an output block 106. The cooling fluid 104 may be water, anti-freeze, etc. Additionally, the cooling fluid 104 may be provided with an anti-fungal or anti-bacterial solution. The cooling fluid 104 flows from the cooling unit 74 to the output block 106. Electrical current 64 from the power source 70 also is coupled to the output block 106.

In the illustrated embodiment, an output cable 108 is connected to the output block 106. The output cable 108 couples cooling fluid and electrical current to the extension cable 62. The extension cable 62, in turn, couples cooling fluid 104 and electrical current 64 to the fluid-cooled induction heating cable 56. In the illustrated embodiment, cooling fluid 104 flows from the output block 106 to the fluid-cooled induction heating cable 56 along a supply path 110 through the output cable 108 and the extension cable 62. The cooling fluid 104 returns to the output block 106 from the fluid-cooled induction heating cable 56 along a return path 112 through the extension cable 62 and the output cable 108. AC electric current 64 also flows along the supply and return paths. The AC electric current 64 produces a magnetic field that induces current, and thus heat, in the workpiece 52. Heat, produced either from the workpiece 52 or by the AC electrical current flowing through the conductors in the heating cable 56, is carried away from the heating cable 56 by the cooling fluid 104. Additionally, the insulation blanket 58 forms a barrier to reduce the transfer of heat from the workpiece 52 to the heating cable 56.

Referring generally to FIGS. 1 and 4, in the illustrated embodiment, the fluid-cooled induction heating cable 56 has a connector assembly 114. The extension cable 62 has a pair of connector assemblies 114 at one end and a second pair of connector assemblies 114 at the other end. In the illustrated embodiment, each connector assembly separately couples electricity and cooling fluid. The connector assemblies are electrically coupled by connecting an electrical connector 118 in one connector assembly 114 with an electrical connector 118 in another connector assembly 114. Each of the connector assemblies also has a hydraulic fitting 122. The connector assemblies are fluidicly coupled by routing a jumper 124 from the hydraulic fitting 122 in one connector assembly 114 to the hydraulic fitting 118 in another connector assembly 114. Electrical current 64 flows through the electrical connectors and fluid 104 flows through the hydraulic fittings 122 and jumper 124. In the illustrated embodiment, cooling fluid 104 from the heating cable 56 is then coupled to the controller 72. Cooling fluid flows from the controller 72 back to the cooling unit 74. The cooling unit 74 removes heat from the cooling fluid 104 flowing through the heating cable 56. The cooled cooling fluid 104 is then supplied again to the heating cable 56.

Figure 5:
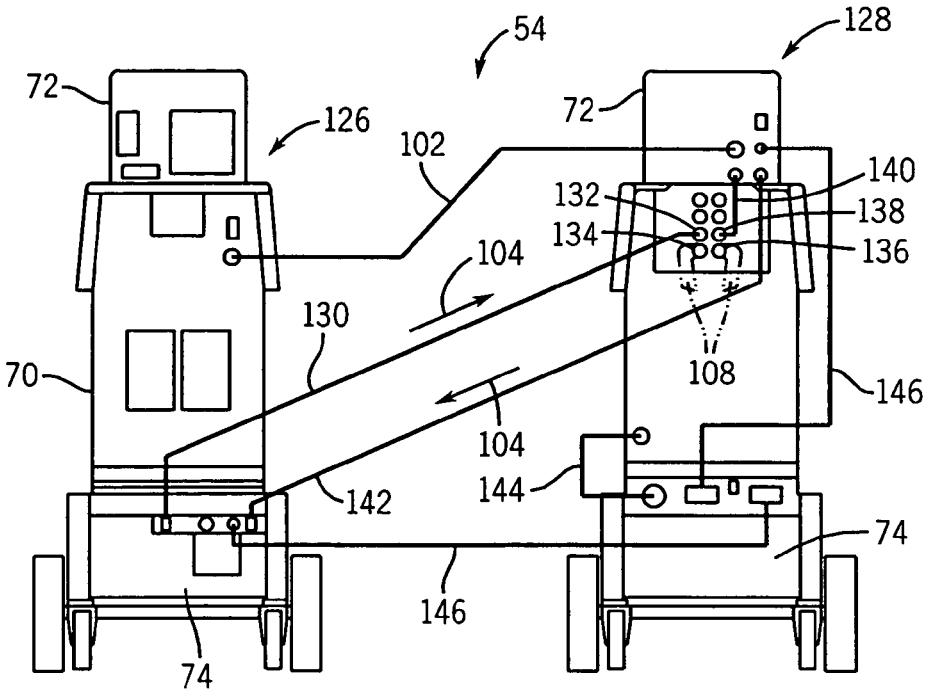
FIG. 5 is an elevational drawing illustrating the front and the rear of an induction heating system, according to an exemplary embodiment of the present technique.

Referring generally to FIG. 5, front and rear views of a single power system 54 are illustrated. In the illustrated embodiment, the front side 126 of the power system 54 is shown on the left and the rear side 128 of the power system 54 is shown on the right. A first hose 130 is used to route fluid 104 from the front of the cooler 74 to a first terminal 132 of the output block 106 on the rear of the power source 70. The first terminal 132 is fluidicly coupled to a second terminal 134 of the output block 106. The output cable 108 is connected to the second terminal 134 and a third terminal 136. The second and third terminals are operable to couple both cooling fluid and electric current to the output cable 108. Supply fluid flows to the heating cable 56 through the second terminal 134 and returns from the heating cable 56 through the third terminal 136. The third terminal 136 is, in turn, fluidicly coupled to a fourth terminal 138. A second hose 140 is connected between the fourth terminal 138 and the controller 72. A third hose 142 is connected between the controller 72 and the cooling unit 74 to return the cooling fluid to the cooling unit 74, so that heat may be removed. In the illustrated embodiment, the output block 106 may be adapted to supply electric current to air-cooled induction devices (not shown). An electrical jumper cable 144 is used to route 460 Volt, 3-phase power to the power source 70. Various electrical cables 146 are provided to couple 115 Volt power from the step-down transformer 100 to the controller 72 and the cooling unit 74.

Figure 6:
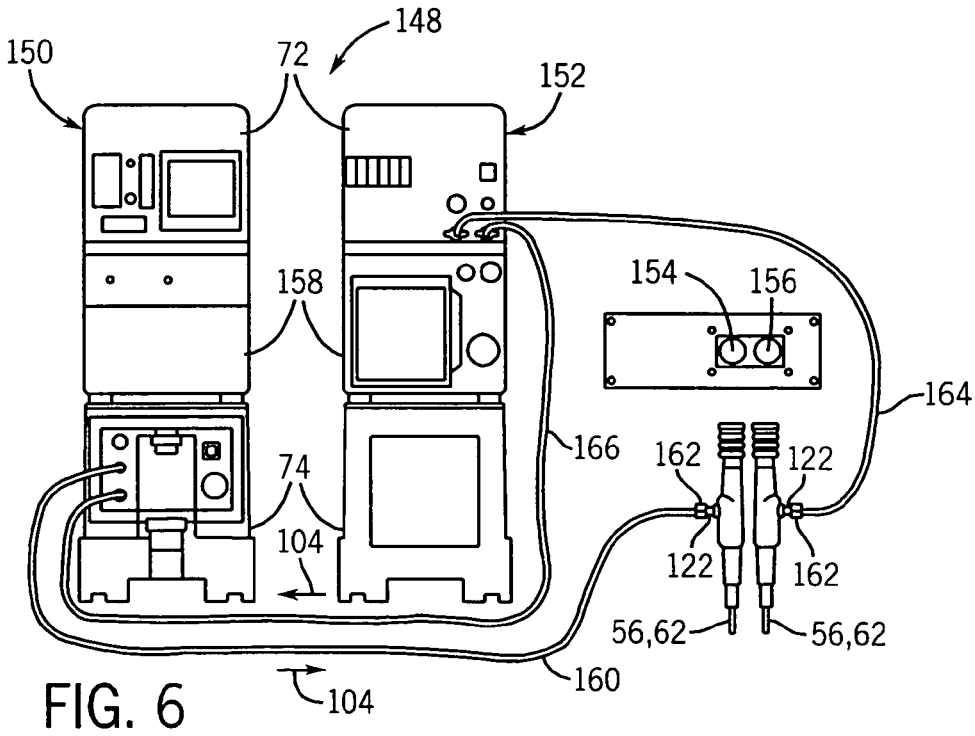
FIG. 6 is an elevational drawing illustrating the front and the rear of an induction heating system, according to an alternative embodiment of the present technique.

Referring generally to FIG. 6, front and rear views of a single alternative power system 148 are illustrated. In the illustrated embodiment, the front side 150 of the alternative power system 148 is shown on the left, and the rear side 152 of the alternative power system 148 is shown on the right. In the illustrated embodiment, cooling fluid is not routed through an output block in the power source. The heating cable 56 or an extension cable 62 is connected to a first output connector 154 and a second output connector 156 of an alternative embodiment of a power source 158. A first hose 160 is used to couple cooling fluid 104 from the cooling unit 74 to a first or second connector assembly on the heating cable 56 or extension cable 62. The first hose is adapted with a hydraulic fitting 162 configured for mating engagement with a hydraulic fitting 122 on the connector assemblies. A second hose 164 with a hydraulic fitting 162 is used to couple the controller 72 to a connector assembly 114 on the heating cable 56 or extension cable 62. A third hose 166 is routed between the controller 72 and the cooling unit 74 to complete the fluid flow path.

Figure 7:
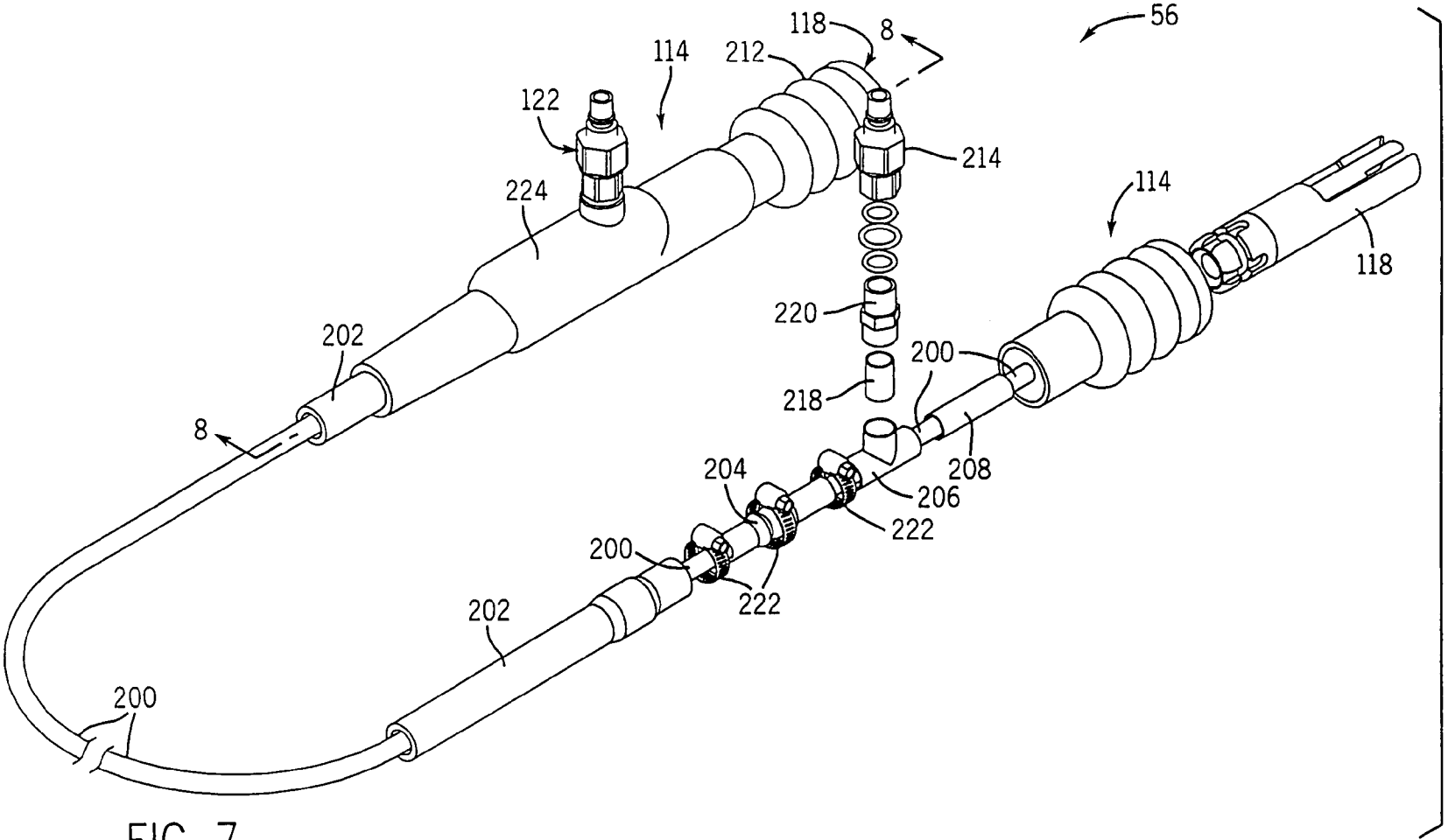
FIG. 7 is a partial exploded view of a fluid-cooled induction heating cable, according to an exemplary embodiment of the present technique.

Referring generally to FIG. 7, the AC electric current is typically produced at a high frequency, such as a radio frequency. At high frequencies, the current carried by a conductor is not uniformly distributed over the cross-sectional area of the conductor, as is the case with DC current. This phenomenon, referred to as the "skin effect", is a result of magnetic flux lines that circle part, but not all, of the conductor. At radio frequencies, approximately 90 percent of the current is carried within two skin depths of the outer surface of a conductor. For example, the skin depth of copper is about 0.0116 inches at 50 KHz, and decreases with increasing frequency. The reduction in the effective area of conduction caused by the skin effect increases the effective electrical resistance of the conductor.

In the illustrated embodiment, the heating cable 56 utilizes a litz wire 200 to produce the magnetic field. The litz wire 200 is used to minimize the effective electrical resistance of the fluid-cooled induction heating cable 56 at high frequencies. A litz wire 200 utilizes a large number of strands of fine wire that are insulated from each other except at the ends where the various wires are connected in parallel. The individual strands are woven in such a way that each strand occupies all possible radial positions to the same extent. The litz wire 200 is housed within a hose 202. In the illustrated embodiment, the hose 202 is a silicon hose. Cooling fluid flows through the hose 202 around the litz wire 200.

Figure 8:
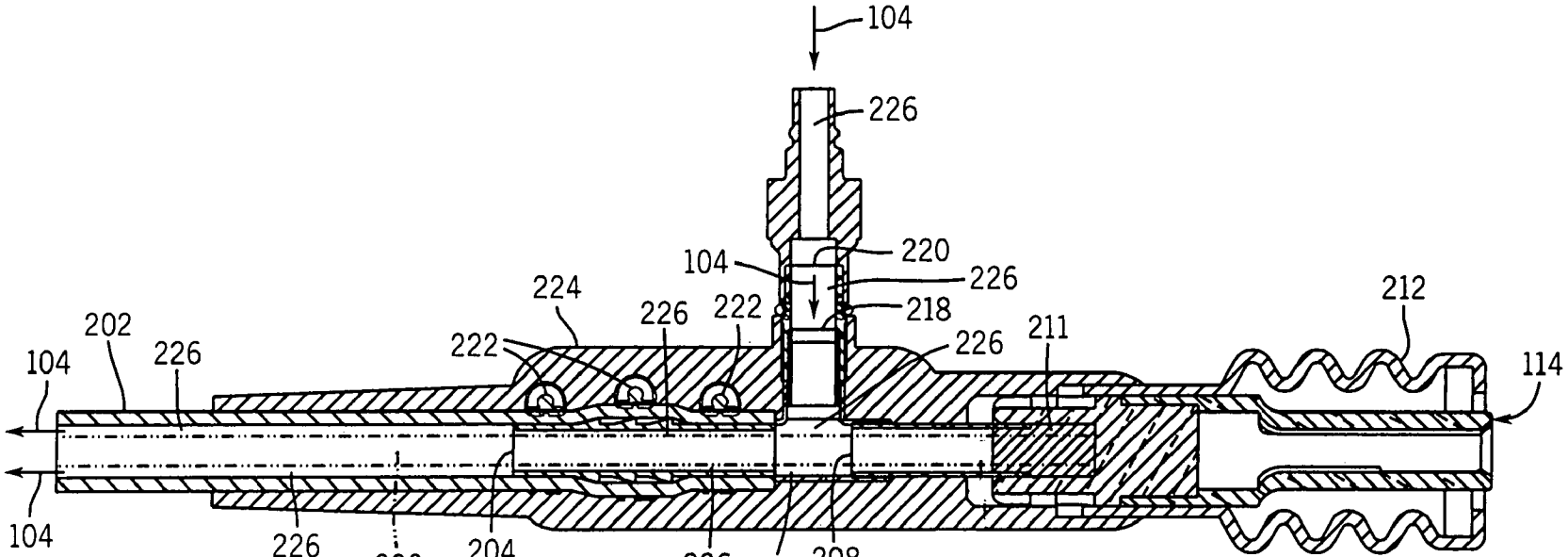
FIG. 8 is a cross-sectional view of the fluid-cooled induction heating cable of FIG. 7, taken generally along line 7-7 of FIG. 7.

As best illustrated in FIG. 8, in this embodiment, each connector assembly 114 comprises a barbed tubing piece 204, a tee section 206, and a piece of straight tubing 208. The litz wire 200 extends through the barbed tubing piece 204, the tee section 206, and the straight tubing 208 in each connector assembly 114. Each end of the litz wire 200 is soldered to the electrical connectors, respectively. A bellows cover 212 is provided to cover and electrically insulate the electrical connectors, respectively.

Referring generally to FIGS. 7 and 8, in the illustrated embodiment, each hydraulic fitting 122 comprises a quick-disconnect nipple 214, at least one piece of straight tubing 218, and an adapter 220. The quick-disconnect nipple 214 enables fluid connections to be made quickly without the use of tools. Additionally, the quick-disconnect nipple 214 and the adapter 220 are configured to enable the quick-disconnect nipple 214 to be easily removed from the adapter 220 if the disconnect nipple 214 becomes damaged or worn. The hose 202 is placed over the barbed section 204. Hose clamps 222 are used to further secure the hose 202 to the barbed section 204. Once assembled, each connector assembly is covered by a polymeric material 224 formed over the connector assembly in a molding process. Cooling fluid 104 flows through each connector assembly in a coolant path 226 formed between the litz wire 200 and the hose 202, the litz wire 200 and the barbed piece 204, the litz wire 200 and the tee section 206, and through the hollow interior of the straight piece 218, the adapter 220, and the quick-disconnect nipple 214.

Figure 9:
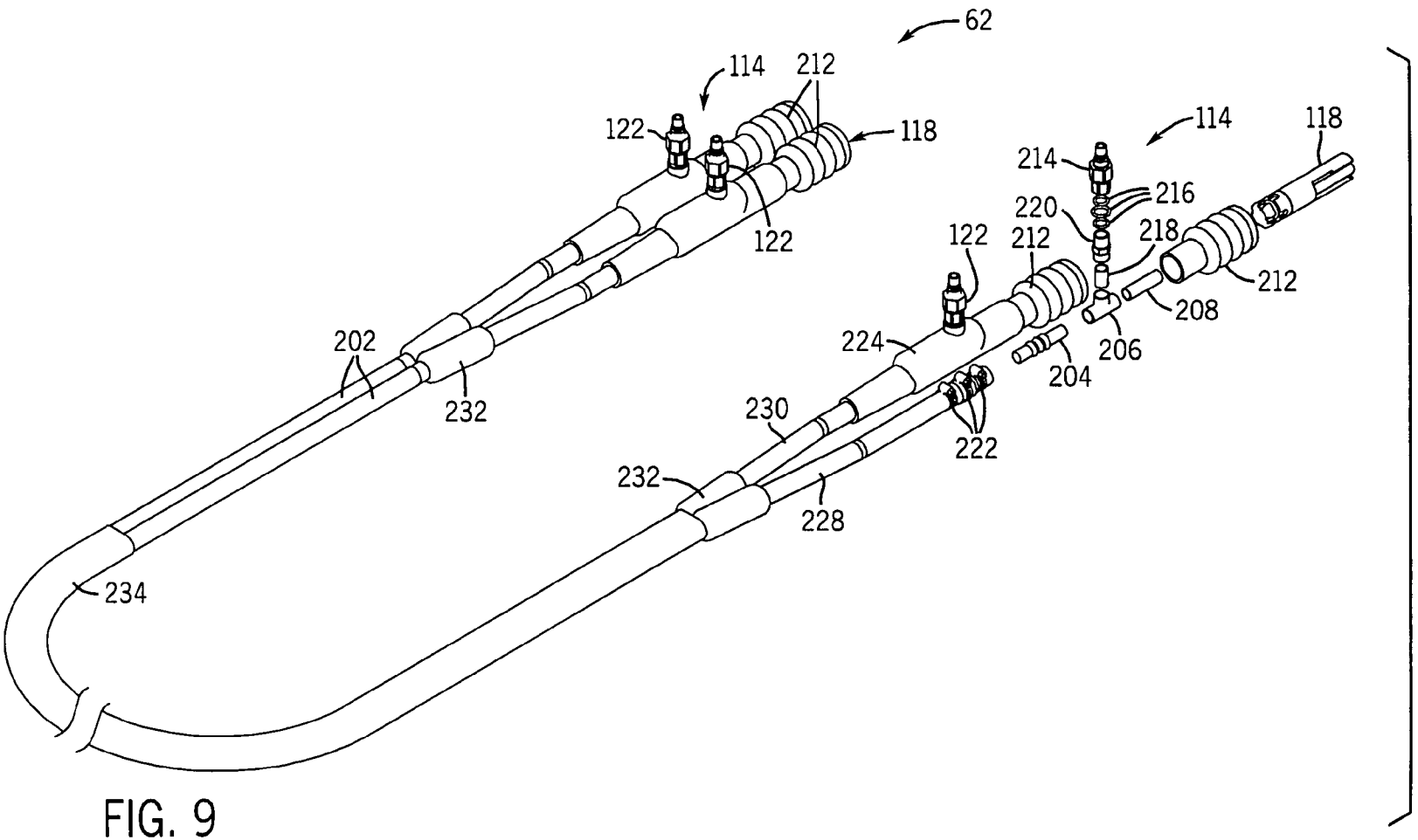
FIG. 9 is a partial exploded view of an extension cable for the fluid-cooled induction heating cable, according to an exemplary embodiment of the present technique.
Figure 10:
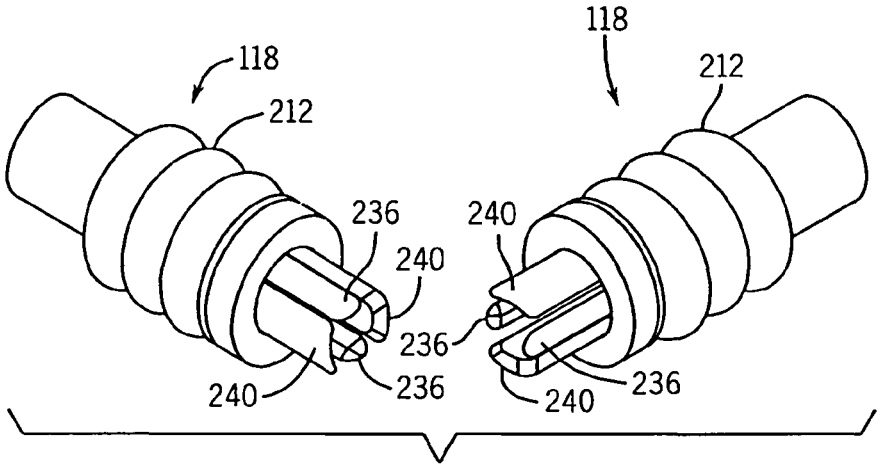
FIG. 10 is a perspective view of electrical connectors, according to an exemplary embodiment of the present technique.

Referring generally to FIG. 9, the extension cable 62 is used to couple electrical current and cooling fluid to and from the heating cable 56. The extension cable 62 comprises a first extension 228 and a second extension 230. One extension is used to form part of the supply path 110 of cooling fluid 104 and electrical current 64 to the fluid-cooled induction heating cable 56, and the other extension is used to form part of the return path 112. In the illustrated embodiment, either extension may be used in the supply and return paths. In the illustrated embodiment, the first and second extensions are secured together along a portion of their lengths. In this embodiment, a pair of molded pieces 232 and a cover 234 are used to secure the first and second extensions together.

In the illustrated embodiment, one end of the extension cable 62 comprises a pair of connector assemblies 114 and the opposite end comprises a second pair of connector assemblies 114. However, this arrangement may be altered based on the configuration of the heating cable 56 and/or the connectors on the power source. As with the fluid-cooled induction heating cable 56, a litz wire 200 (not shown) is used to electrically couple each electrical connector 118 to a corresponding electrical connector 118. Also, each connector assembly of the extension cable 62 comprises a hydraulic fitting 122 to enable a jumper 124 to be quickly connected to, or quickly disconnected from, the connector assembly.

Referring generally to FIGS. 9-13, the first and second connector assemblies are adapted to enable the fluid-cooled induction heating cable 56 and the extension cable 62 to be coupled both electrically and fluidicly. Additionally, the connector assemblies are adapted to enable the fluid-cooled induction heating cable 56 and extension cable 62 to be quickly connected and disconnected. Furthermore, in the illustrated embodiment, the first and second connector assemblies are configured with a twist-lock feature to enable the first and second connector assemblies to be secured together.

Each electrical connector 118 comprises a pair of prong conductors 236. Additionally, each electrical connector 118 comprises a pair of plate-like connectors 240, the plate-like connectors also being conductors. In the illustrated embodiment, the plate-like connectors 240 are adapted to securely engage opposing plate-like connectors 240.

Figure 11:
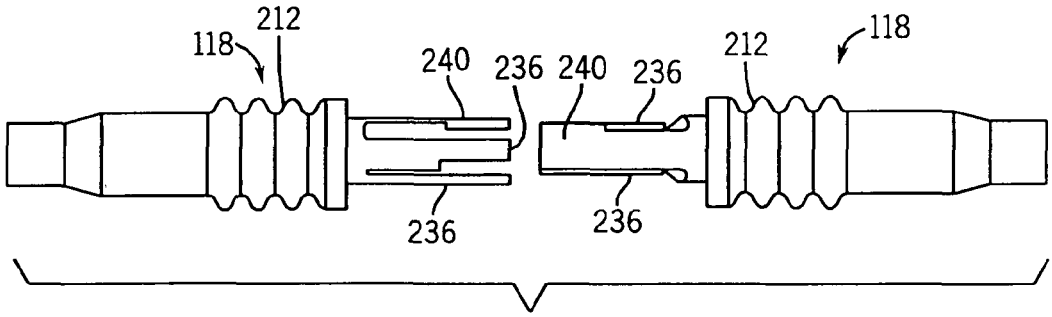
FIG. 11 is a front elevational view illustrating the process of aligning the electrical connectors for connection, according to an exemplary embodiment of the present technique.

Referring generally to FIG. 11, to connect the electrical connectors, the electrical connectors are aligned so that the prong conductors and plate-like connectors are aligned. The electrical connectors are then driven into engagement. The plate-like connectors 240 are driven over and into engagement with the prong conductors 236 and the plate-like connectors 240 are driven over and into engagement with the prong conductors 236. The prong and/or the plate-like connectors are adapted so that they are biased into engagement when the first and second connector assemblies are driven into engagement. This arrangement provides a large surface area for electrical contact between the electrical connectors. It has been found that by increasing the area of surface contact between the electrical connectors the unwanted consequences of the skin effect that occurs in conductors at high frequencies can be reduced.

Figure 12:
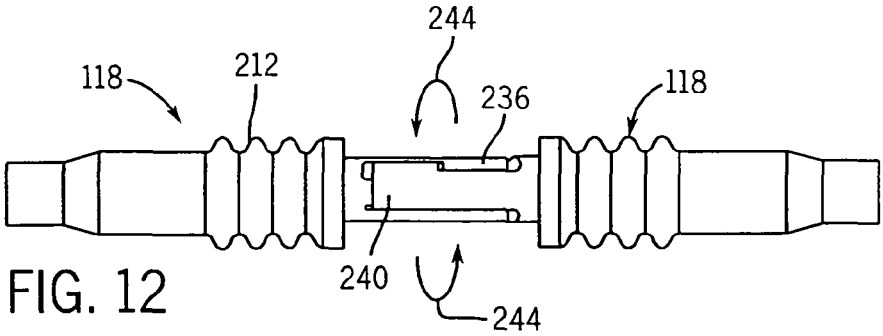
FIG. 12 is a front elevational view illustrating the process of joining and securing the electrical connectors, according to an exemplary embodiment of the present technique.

Referring generally to FIG. 12, once engaged, the electrical connectors are twisted relative to each other, as represented by the arrows 244, to securely engage the first and plate-like connectors. To disconnect the electrical connectors, the electrical connectors are twisted in a second direction, opposite the first direction, so that the plate-like connectors 240 and the plate-like connectors 240 are unsecured. The electrical connectors may then be pulled apart.

Figure 13:
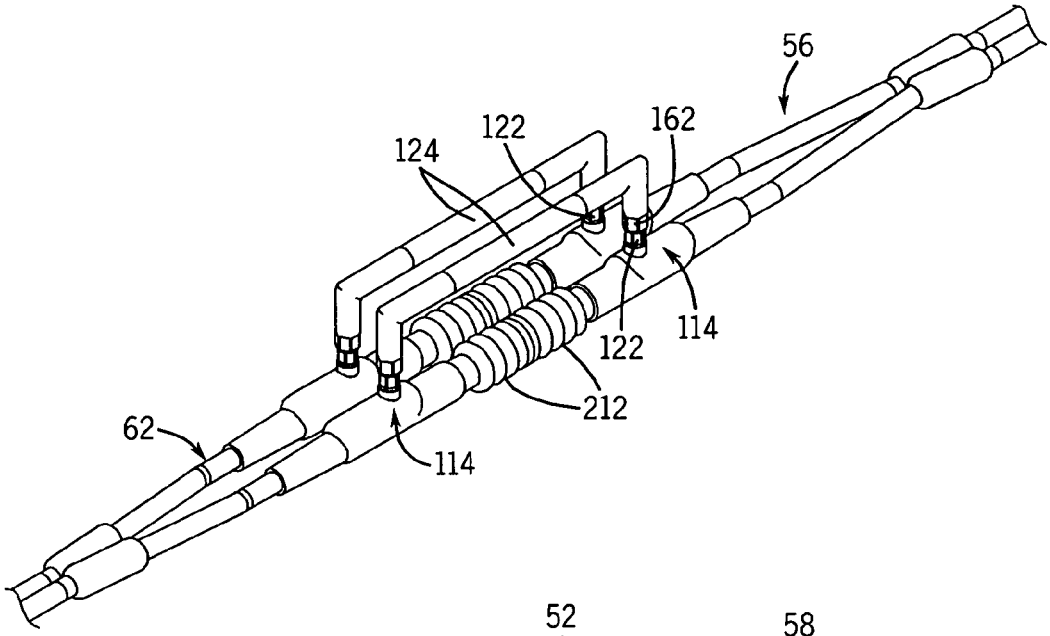
FIG. 13 is a perspective view illustrating the process of connecting the fluid-cooled induction heating cable and the extension for the fluid-cooled induction heating cable, according to an exemplary embodiment of the present technique.

Referring generally to FIG. 13, a pair of jumper hoses 124 are used to fluidicly couple the fluid-cooled induction heating cable 56 and the extension cable 62. The jumper hoses 124 are adapted with quick-disconnect fittings 162 to enable the jumper hoses 124 to be quickly connected to and disconnected from the hydraulic fittings 122 on the connector assemblies 114. Physically separating the electrical connectors from the fluid connectors simplifies the design and manufacture of the first and second connector assemblies. Additionally, physically separating the electrical connectors from the fluid connectors reduces the potential for electrical shock when connecting and disconnecting the system 50.

Figure 14:
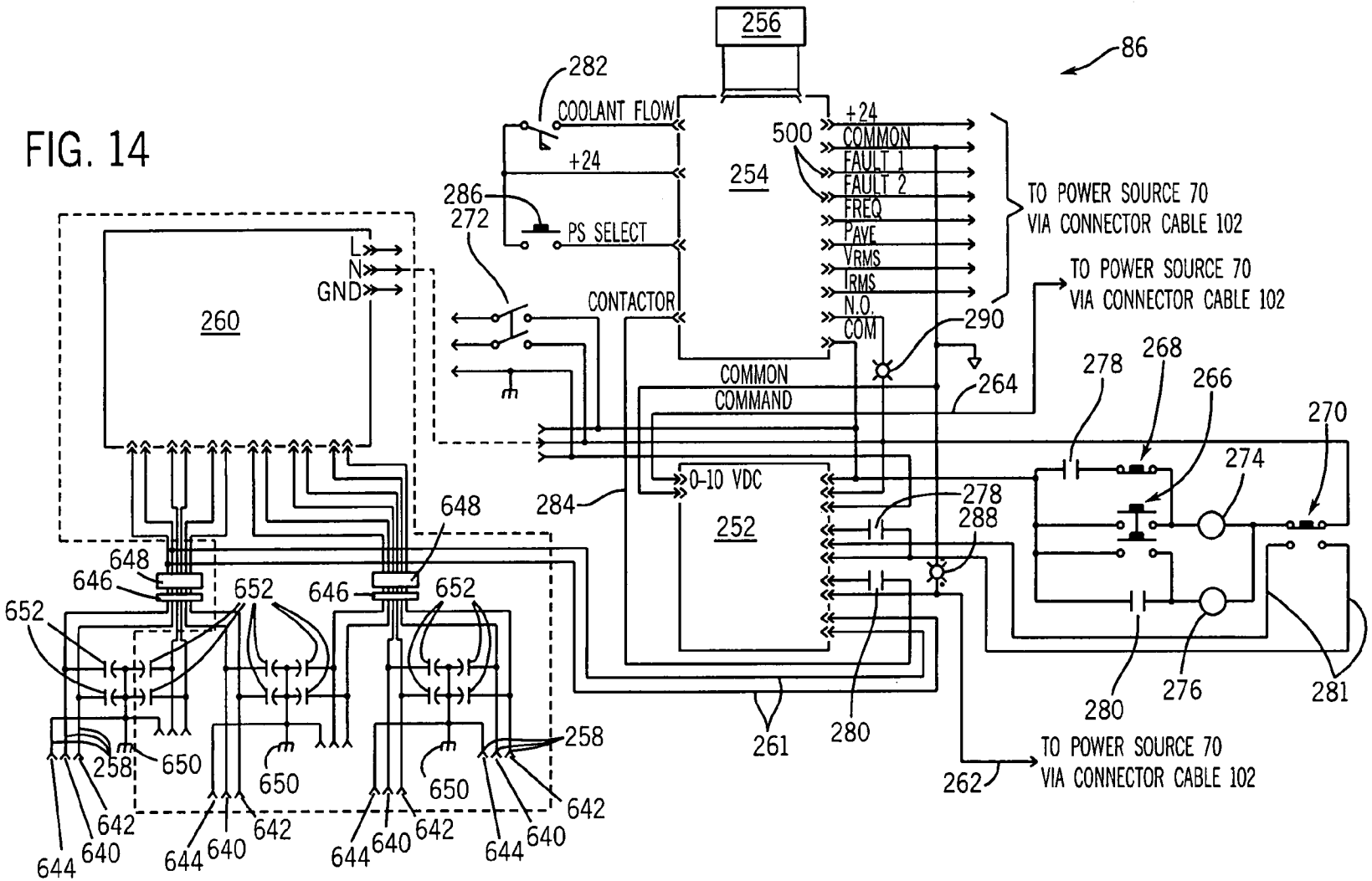
FIG. 14 is an electrical schematic of a controller, according to an exemplary embodiment of the present technique.

Referring generally to FIG. 14, the system 50 may be controlled automatically by the controller 72. The controller 72 has control circuitry 86 that enables the system 50 to receive programming instructions and control the operation of the power source 70 in response to the programming instructions and data received from the power source 70 and temperature feedback device 60. In the illustrated embodiment, the control circuitry 86 comprises a control unit 252, an I/O unit 254, a parameter display 256, and a plurality of electrical switches. Connection jacks 258 are provided to enable the temperature feedback device 60 to be electrically coupled to the controller 72 and to a data recorder 260. At least one temperature feedback device 60 is coupled through the jacks 258 to the control unit 252 via a pair of conductors 261 so as to provide a DC voltage representative of workpiece temperature to the control unit 252. Additional jacks 258 are provided to enable a plurality of temperature feedback devices to be coupled to the data recorder 260. The data recorder 260 may be adapted to record operating parameters, as well. Preferably, the data recorder 260 is a digital device operable to store and transmit data electronically. Alternatively, the controller 72 may have a paper recorder, or no recorder at all. The control unit 252 is operable to receive programming instructions to direct the system 50 to produce a desired temperature profile in a workpiece 52. During operation, the control unit 252 receives temperature data from a temperature feedback device 60 and controls the application of power to the workpiece 52 to achieve a desired workpiece temperature, a desired rate of temperature increase in the workpiece, etc. In addition, the control unit 252 is pre-programmed with operational control instructions that control how the control unit 252 responds to the programming instructions. Accordingly, the control unit 252 may comprise a processor and memory, such as RAM.

There are a number of control schemes that may be used to control the application of heat to the workpiece. For example, an on-off controller maintains a constant supply of power to the workpiece until the desired temperature is reached, then the controller turns off. However, this can result in temperature overshoots in which the workpiece is heated to much higher temperatures than is desired. In proportional control, the controller controls power in proportion to the temperature difference between the desired temperature and the actual temperature of the workpiece. A proportional controller will reduce power as the workpiece temperature approaches the desired temperature. The magnitude of a temperature overshoot is lessened with proportional control in comparison to an on-off controller. However, the time that it takes for the workpiece to achieve the desired temperature is increased. Other types of control schemes include proportional-integral (PI) control and proportional-derivative (PD) control. Preferably, the control unit 252 is programmed as a proportional-integral-derivative (PID) controller. However, the control unit also may be programmed with PI, PD, or other type of control scheme. The integral term provides a positive feedback to increase the output of the system near the desired temperature. The derivative term looks at the rate of change of the workpiece temperature and adjusts the output based on the rate of change to prevent overshoot.

The control unit 252 provides two output signals to the power source 70 via the control cable 102. The power source 70 receives the two signals and operates in response to the two signals. The first signal is a contact closure signal 262 that energizes contacts in the power source 70 to enable the power source 70 to apply power to the induction heating cable 56. The second signal is a command signal 264 that establishes the percentage of available power for the power source 70 to apply to the induction heating cable 56. The voltage of the command signal 264 is proportional to the amount of available power that is to be applied. The greater the voltage of the command signal 264, the greater the amount of power supplied by the power source. In this embodiment, a variable voltage was used. However, a variable current may also be used to control the amount of power supplied by the power source 70.

Figure 15:
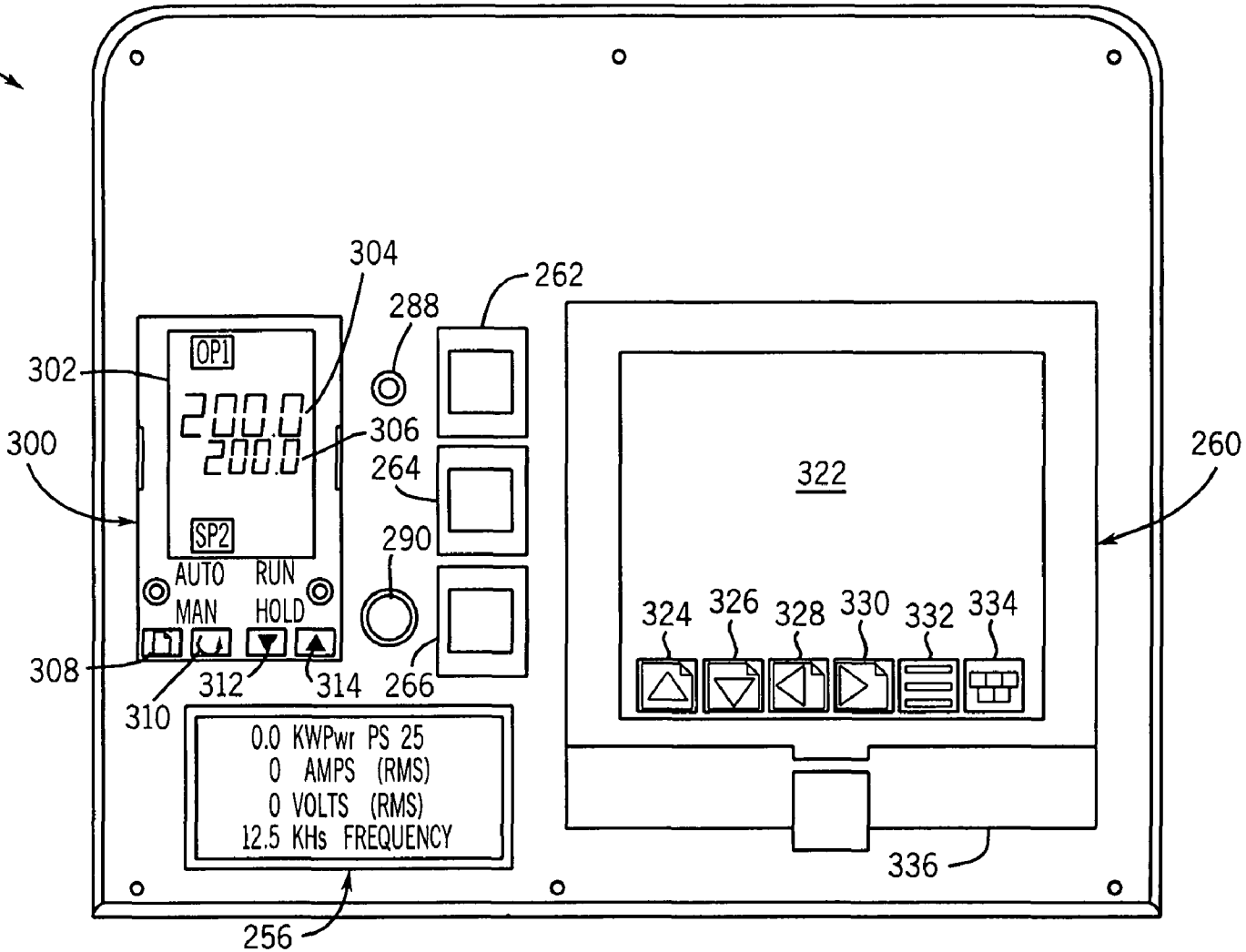
FIG. 15 is a front elevational view of a controller, according to an exemplary embodiment of the present technique.

Referring generally to FIGS. 14 and 15, the electrical switches that provide signals to the control unit 252 include a run button 266, a hold button 268, and a stop button 270. In addition, a power switch 272 is provided to control the supply of power to the controller 72. The run button 266 directs the control unit 252 to begin operating in accordance with the programming instructions. When the run button 266 is closed to begin the induction heating process, a first relay 274 and a second relay 276 are energized. When energized, the first relay closes first contacts 278 and the second relay 276 closes second contacts 280. The relays and contacts maintain power coupled to the control unit 252 after the run button 266 is released. The relays and contacts maintain signals coupled to the control unit 252 after the run button 266 is released.

The hold button 268 stops the timing feature of the controller 72 and directs the control unit 252 to maintain the workpiece at the current target temperature. The hold button 268 enables the system 50 to continue operating while new programming instructions are provided to the controller 72. When operated, the hold button 268 opens, removing power from the first relay 274 and opening the first contacts 278. This directs the controller to remain at the current point in the heating cycle so that the heating cycle begins right where it was in the cycle when operation returns to normal. Additionally, the second relay 276 remains energized, maintaining the second contacts 280 closed to allow the power supply to continue to provide power to the induction heating coil 56. The run button 266 is re-operated to redirect the control unit 252 to resume operation in accordance with the programming instructions. When re-operated, the first relay 274 is re-energized and the first contacts 278 are closed. The stop button 270 directs the control unit 252 to stop heating operations. In the illustrated embodiment, a circuit 281 is completed when the stop button 270 is fully depressed. The circuit 281 directs the control unit 252 to be reset to the first segment of the heating cycle.

The I/O unit 254 receives data from the power source 70 and couples it to the control unit 252 and/or the parameter display 256. The data may be a fault condition recognized by the power source 70 or operating parameters of the power source 70, such as voltage, current, frequency, and the power of the signal being provided by the power source 70 to the inductive heating cable 56. The I/O unit 254 receives the data from the power source 70 via the control cable 102.

In the illustrated embodiment, the I/O unit 254 also receives an input from a flow switch 282. The flow switch 282 is closed when there is adequate cooling flow returning from the inductive heating cable 56. When fluid flow through the flow switch 282 drops below the required flow rate, flow switch 282 opens and the I/O unit 254 provides a signal 284 to the control unit 252 to direct the power source 70 to discontinue supplying power to the induction heating cable 56. Additionally, the flow switch 282 is located downstream, rather than upstream, of the inductive heating cable 56 so that any problems yea with coolant flow, such as a leak in the inductive heating cable 56, are detected more quickly.

A power source selector switch 286 is provided to enable a user to select the appropriate scale for display of power on the parameter display for the power source coupled to the controller 72. The power selector switch 286 enables a user to thereby set the controller for the specific power source controlled by the controller 72. For example, the controller 72 may be used to control a variety of different powers having the same voltage range corresponding to the percentage output of the power source. Thus, a 5 volt output from a 50 KW power source would represent 25 KW while a 5 volt output from a 20 KW power source would represent only 10 KW. The power source selector switch 286 enables a user to toggle through a selection of power source maximum output powers, 5 KW, 25 KW, 50 KW, etc., corresponding to the maximum output power of the power source 72.

The controller 72 also has a plurality of visual indicators to provide a user with information. One indicator is a heating light 288 to indicate when power source output contacts are closed to enable current to flow from the power source 70 to the induction heating cable 56. Another indicator is a fault light 290 to indicate to a user when a problem exists. The fault light may be lit when there is an actual fault, such as a loss of coolant flow, or when an improper power source 70 condition exists, such as a power or current limit or fault.

Referring generally to FIG. 15, the control unit 252 is programmed from the exterior of the controller 72. In addition, the exterior of the controller 72 has a number of operators and indicators that enable a user to operate the system 50. For example, the control unit 252 has a temperature controller 300 that enables a user to input programming instructions to the control unit 252. The illustrated temperature controller 300 has a digital display 302 that is operable to display programming instructions that may be programmed into the system 50. In the illustrated embodiment, the digital display 302 is operable to display both the actual workpiece temperature 304 and a target temperature 306 that has been programmed into the system 50. The digital display 302 may also display other temperature information, such as the segment type/function and the programmed rate of temperature change. The illustrated temperature controller 300 has a page forward button 308, a scroll button 310, a down button 312, and an up button 314 that are used to program and operate the system 50. To program the control unit 252, the page forward button 308 is operated until a programming list is displayed.

Each heating operation for each segment of a temperature profile may be programmed into the controller 72 from the programming list. The system 50 is operable to perform at least four basic types of heating operations: step, dwell, ramp rate, and ramp time. A step operation is a heating operation where the desired temperature of the workpiece changes in a step increment from a current value to a new value. The system 50 will automatically begin operating to change the workpiece temperature to the new value. A dwell operation is a heating operation wherein the system automatically operates to maintain the workpiece at a desired temperature for a specified period of time. A ramp time operation is a heating operation wherein the system operates to change the workpiece temperature linearly from a current value to a new value over a defined period of time. The ramp rate operation is a heating operation wherein the system operates to ramp the workpiece temperature linearly from a current temperature to a new temperature at a defined rate of change. The specific type of heating operation may be selected from the programming list using the scroll button 310. The up button 314 and the down button 312 enable a user to input specific desired values to the controller 72.

Also present on the exterior of the controller 72 is the parameter display 256. The parameter display 256 provides a user with system operating parameter data received by the I/O unit 254. For example, the illustrated parameter display 256 is operable to provide a user with the power available from the power source 70 and the power that is currently being provided by the power source 70. The parameter display 256 also is operable to provide a user with the values of the AC output current and the AC output voltage of the power source 70. The parameter display 256 also is operable to provide a user with the frequency of the AC output current to the flexible inductive heating cable 56. Additionally, the display 256 is operable to provide messages indicating, for example, a coolant flow error or power source limit error.

Additionally, the digital recorder 260 has a touch-screen display 322 that is present on the exterior of the controller 72. The illustrated touch-screen display 322 is operable to display temperature information from one or more temperature feedback devices 60. For example, the touch-screen display 322 is operable to visually graph the temperature of the workpiece over time. The touch-screen display 322 may be operable to display system operating parameter information, as well. The touch-screen display 322 is operable to display a number of icons that are activated by touching the touch-screen display 322. The illustrated touch-screen display 322 has a page up icon 324, a page down icon 326, a left icon 328, a right icon 330, an option icon 332, and a root icon 334. The touch-screen display 322 may have additional or alternative icons. The name of the system user who performed the inductive heating operation may be added for display on the touch-screen display 322. Other information, such as a description of the workpiece 52, may also be added for display. Additionally, the illustrated data recorder 260 has a disc drive 336. The disc drive 336 is operable to receive data stored in the data recorder 260 for transfer to a computer system. In addition, or alternatively, to the disc drive 336, the recorder 260 may have the capability for networking, such as a RJ45 network connection, and/or a PCMCIA card.

Figure 16:
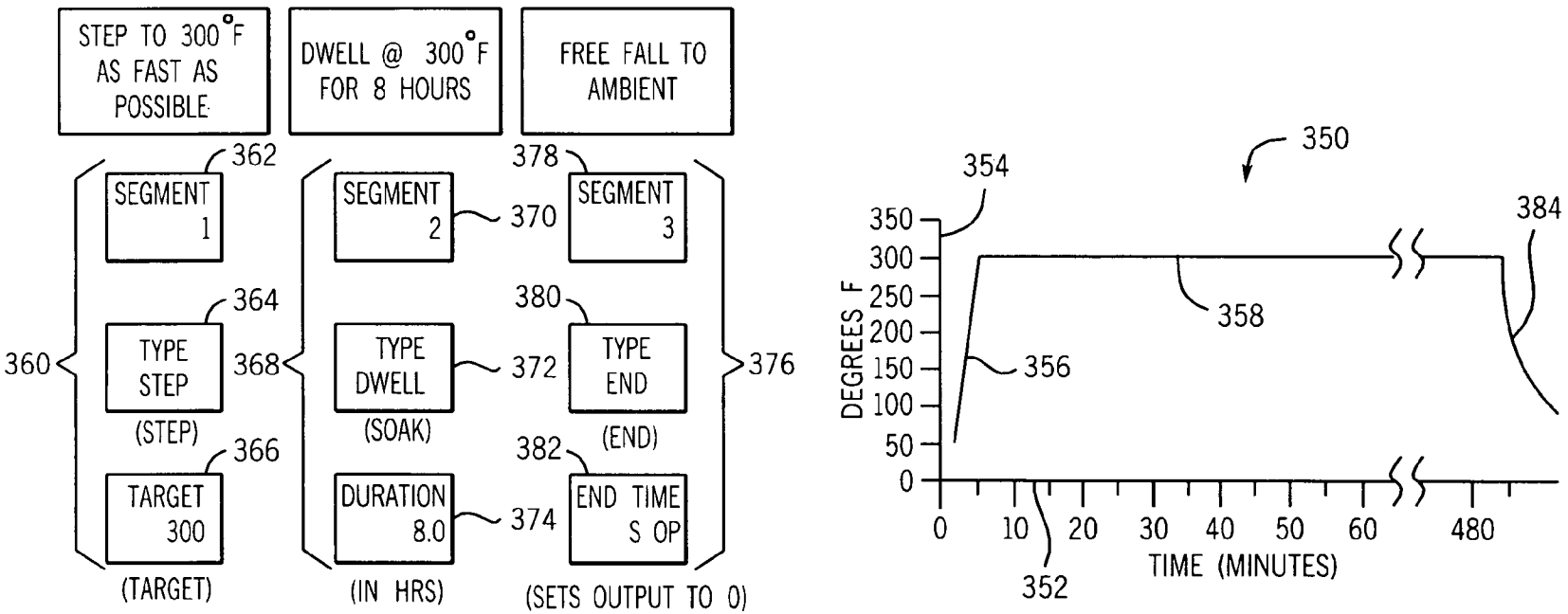
FIG. 16 is a desired temperature profile of a workpiece to preheat the workpiece for welding.

Referring generally to FIG. 16, an example of an induction heating operation that may be programmed into the controller 72 is illustrated. FIG. 16 illustrates a typical temperature profile 350 for pre-heating a workpiece for welding. In FIG. 16, the x-axis 352 represents time in minutes and the y-axis 354 represents temperature in degrees Fahrenheit. The illustrated pre-heating temperature profile 350 has a first segment 356 and a second segment 358. During the first segment 356, it is desired that the temperature of the workpiece 52 rise from its present temperature to 300° F. During the second segment 358, it is desired that the workpiece 52 remain at 300° F. for 8 hours.

To program the system 50, the temperature profile 350 is broken up into segments. To produce the first segment 356 of the temperature profile 350, a first series 360 of programming instructions are provided to the temperature controller 300. The page forward button 308 is operated until the programming list is displayed. The segment function is selected from the programming list and set for a first segment, as represented by icon 362 displayed on the digital display 302. The step function is then selected from the programming list, as represented by icon 364 displayed on the digital display 302. The up button 314 and/or the down button 312 are operated to set the desired temperature for the step function to 300° F., as represented by icon 366 displayed on the digital display 302.

A second series 368 of programming instructions are provided to the temperature controller 300 to produce the second segment 358 of the temperature profile 350 in the workpiece. The segment function is selected from the programming list and set for a second segment, as represented by icon 370 displayed on the digital display 302. The dwell function is then selected from the programming list, as represented by icon 372. The duration of the dwell function is then set for 8 hours, as represented by icon 374 displayed on the digital display 302. To end the pre-heating operation, a third series 376 of programming instructions are provided to the temperature controller. The segment function is selected from the programming list and set for a third segment, as represented by icon 378 displayed on the digital display 302. The end heating function is then selected from the programming list, as represented by icon 380 displayed on the digital display 302. The output power of the system 50 is set to 0, as represented by icon 382 displayed on the digital display 302. The temperature of the workpiece 52 will fall to ambient temperature, as represented by the third segment 384 of the temperature profile 350.

To start the heating operation, the run button 266 is operated. The power source will energize and the heat on light 288 will illuminate. The power source parameters will be displayed on the parameter display 256 and the temperature information from the temperature feedback device 60 is displayed on the temperature controller 300. The control unit 252 will control operation of the power source 70 to heat the workpiece according to the programmed instructions. In the illustrated embodiment, the temperature controller 300 will flash "hold" until the measured temperature climbs to within a preset temperature difference, the hold back temperature, of the target temperature. The hold back temperature may be programmed into the control unit 252, as well.

To adjust the temperature profile during the heating cycle, the hold button 268 is operated. The page button is operated to display the program list. The scroll button then is operated to select the desired parameter for changing. The up and down buttons are operated to change the value of the parameter. Once the value of the parameter has been changed, the page buttons are operated to return to the parameter screen. The run button 266 then is operated to resume the heating program. The stop button 270 is operated when the heating cycle has been completed or to abort the heating process during the heating cycle. The controller 72 will reset to the first segment and the power source contactor relay will open.

Figure 17:
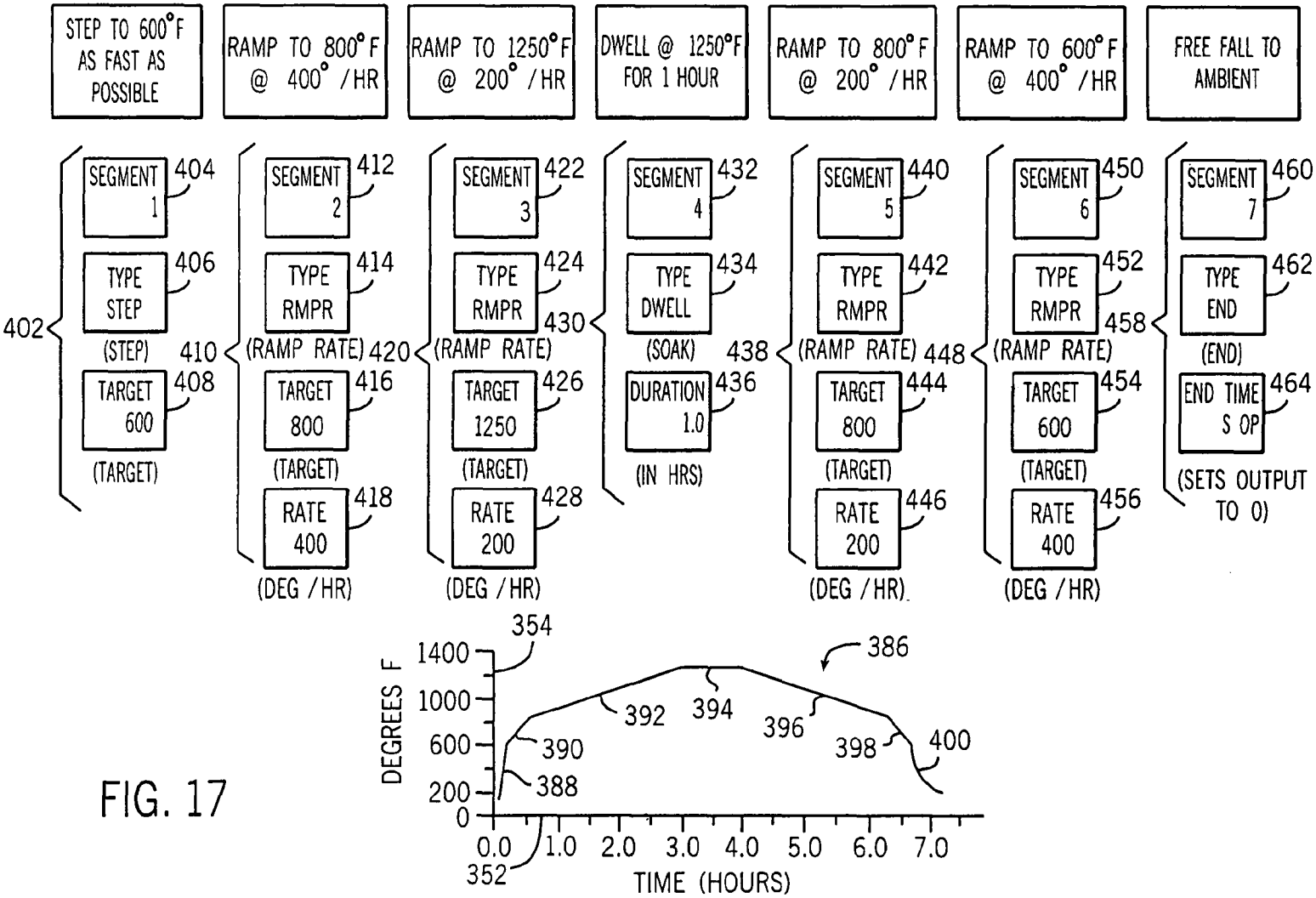
FIG. 17 is a desired temperature profile of a workpiece to relieve stress from the workpiece after welding.

Referring generally to FIG. 17, another example of an induction heating operation that may be performed with the induction heating system 50 is illustrated. FIG. 17 illustrates an exemplary temperature profile 386 for relieving stress in a workpiece 52, e.g., to relieve stress from a weld joint after welding. FIG. 17 also illustrates the series of programming instructions that may be entered into the temperature controller 300 beforehand to automatically produce the illustrated stress-relief temperature profile 386. The illustrated stress-relieving temperature profile 386 has a first segment 388, a second segment 390, a third segment 392, a fourth segment 394, a fifth segment 396, a sixth segment 398, and a seventh segment 400.

During the first segment 388 of the illustrated temperature profile 386, it is desired to raise the temperature of the workpiece 52 from its present temperature to a temperature of 600° F. During the second segment 358, it is desired that the workpiece temperature rise to 800° F. at a rate of 400° F. During the third segment 392, it is desired that the workpiece temperature rise to 1250° F. at a rate of 200° F. During the fourth segment 394, it is desired that the temperature of the workpiece 52 remain at 1350° F. for 1 hour. During the fifth segment 396, it is desired that the temperature of the workpiece decrease to 800° F. at a rate of 200° F. per hour. During the sixth segment 398, it is desired that the temperature of the workpiece 52 decrease to 600° F. at a rate of 400° F. per hour. During the seventh segment 400, it is desired that heating operation cease and the workpiece cool to ambient temperature.

A first series 402 of programming instructions are provided to the temperature controller 300 to produce the first segment 388 of the stress-relief temperature profile 386. The segment function is selected from the programming list and set for a first segment, as represented by icon 404 displayed on the digital display 302. The step function is then selected, as represented by icon 406. The up button 314 and/or the down button 312 are operated to set the desired temperature for the step function to 600° F., as represented by icon 408.

A second series 410 of programming instructions are provided to the temperature controller 300 to produce the second segment 390 of the stress-relieving temperature profile 386. The segment function is selected from the programming list and set for a second segment, as represented by icon 412. The ramp rate function is then selected from the programming list, as represented by icon 414. The desired temperature is then set on the temperature controller 300 to the desired temperature of 800° F., as represented by icon 416. The desired rate of temperature change of 400° F. per hour is then set on the temperature controller 300, as represented by icon 418.

A third series 420 of programming instructions are provided to the temperature controller 300 to produce the third segment 392 of the stress-relieving temperature profile 386. The segment function is selected from the programming list and set for a third segment, as represented by icon 422 displayed on the digital display 302. The ramp rate function is then selected, as represented by icon 424. The target temperature of 1250° F. is then set, as represented by icon 426. The desired rate of temperature change is set to 200° F./hr, as represented by icon 428.

A fourth set 430 of programming instructions are preset into the temperature controller 300 to produce the fourth segment 394 of the temperature profile 386. The segment function for the fourth segment is selected, as represented by icon 432. The dwell function is selected from the programming list, as represented by icon 434. The duration is then set for 1 hour, as represented by icon 436.

A fifth series 438 of programming instructions are provided to the temperature controller 300 to produce the fifth segment 396 of the stress-relieving temperature profile 386. The segment function is selected from the programming list and set for a fifth segment, as represented by icon 440. The ramp rate function is then selected from the programming list, as represented by icon 442. The desired temperature is then set on the temperature controller 300 to the desired temperature of 800° F., as represented by icon 444. The desired rate of temperature change of 200° F. per hour is then set on the temperature controller 300, as represented by icon 446.

A sixth series 448 of programming instructions are provided to the temperature controller 300 to produce the sixth segment 398 of the stress-relieving temperature profile 386. The segment function is selected from the programming list and set for a sixth segment, as represented by icon 450. The ramp rate function is then selected from the programming list, as represented by icon 452. The desired temperature is then set on the temperature controller 300 to the desired temperature of 600° F., as represented by icon 454. The desired rate of temperature change of 400° F. per hour is then set on the temperature controller 300, as represented by icon 456.

A seventh series 458 of programming instructions are provided to the temperature controller to end the stress-relieving heating operation. The segment function is selected from the programming list and set for a seventh segment, as represented by icon 460. The end heating function is then selected from the programming list, as represented by icon 462. The output power of the system 50 is set to 0, as represented by icon 464. Once the programming instructions are provided and the conditions for operating the system 50 are established, the run button 266 may be operated to direct the system to automatically produce the programmed temperature profile. As discussed above, the data recorder 260 is operable to store temperature profile data received from each of the temperature feedback devices 60. The data may be stored in the recorder and transferred to a disc (not shown) in the disc drive 336. The disc from the disc drive 336 may then be transferred to a computer system, such as a personal computer. The computer system may be used to analyze the data.

Figure 18:
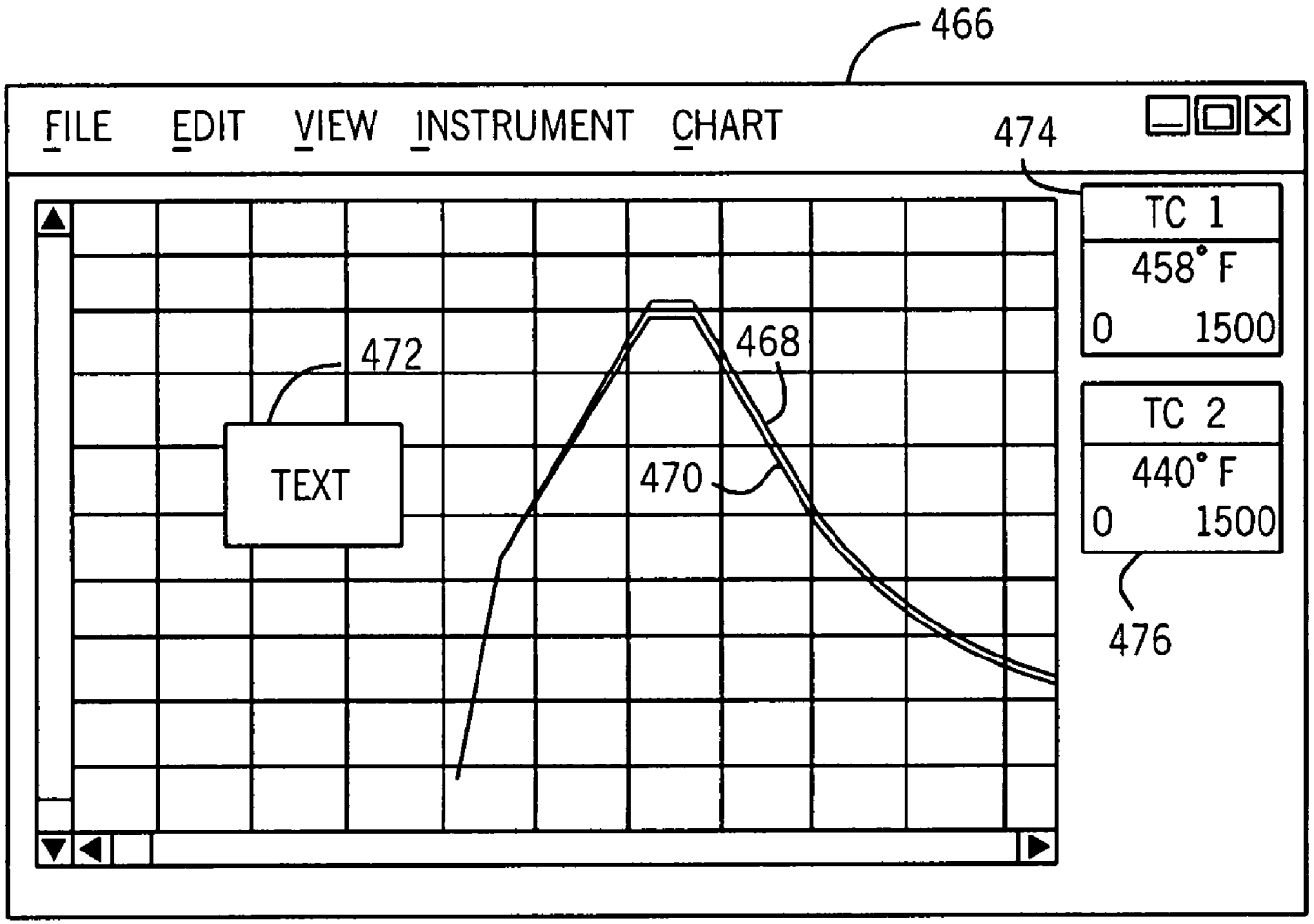
FIG. 18 is a representation of a graphical user interface for a computer system operable to display temperature data recorded by a recording device in the controller.

As illustrated in FIG. 18, a computer system may be used to provide the data in a graphical user interface 466. In the illustrated embodiment, a first graphical representation 468 of the temperature information received from a first temperature feedback device 60 and a second graphical representation 470 of the temperature information received from a second temperature feedback device 60 are displayed. The computer system may also be used to add text 472 to the temperature profile. Additionally, the temperature of the workpiece 52 at a specific time may be displayed numerically. For example, a cursor may be used to select a specific time on the graphical representations. In the illustrated embodiment, the actual temperature data received from the first temperature device at the selected time is displayed in a first box 474 and the actual temperature data received from the second temperature feedback device at the selected time is displayed in a second box 476.

Figure 19:
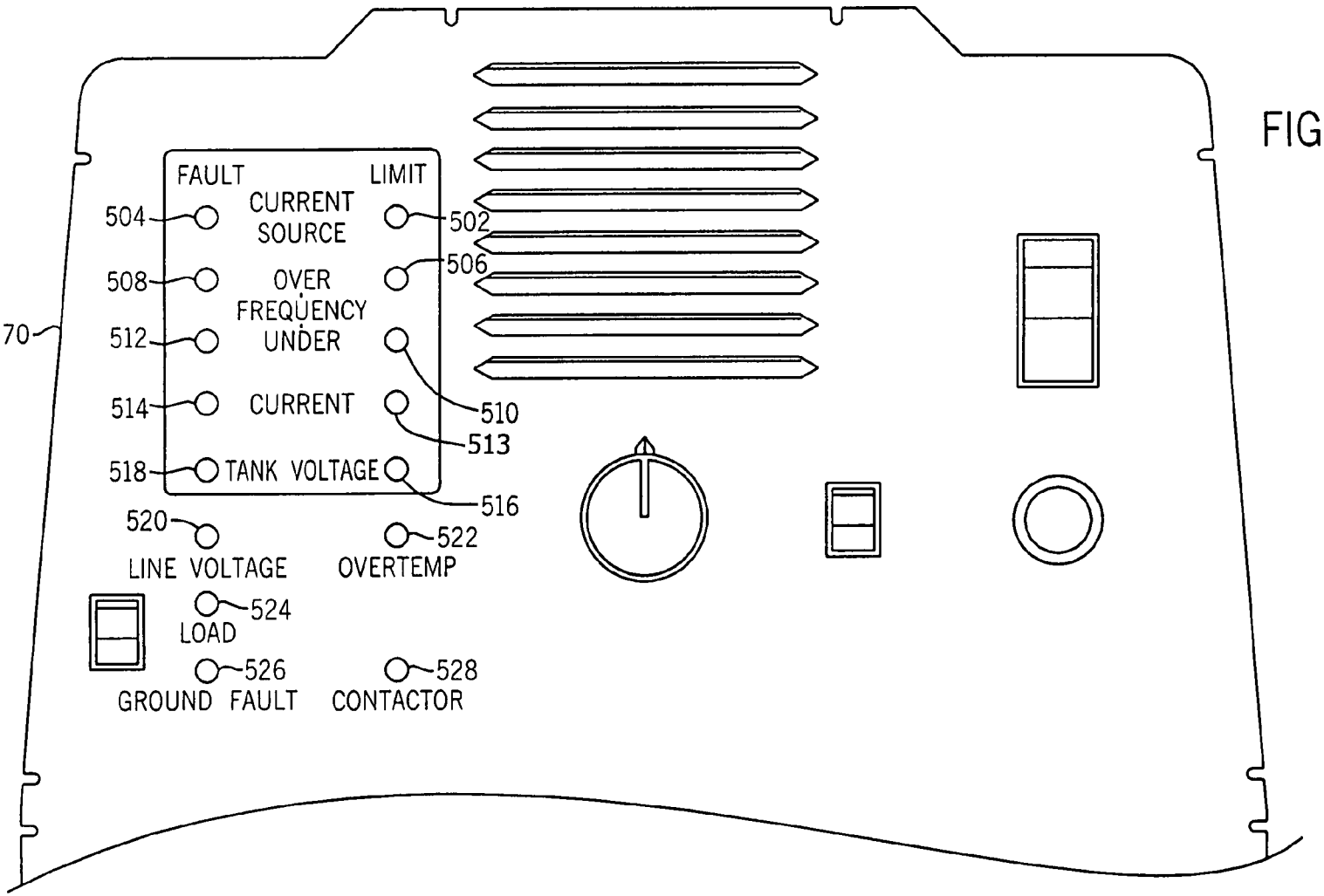
FIG. 19 is a front elevational view of a power source, according to an exemplary embodiment of the present technique.

Referring generally to FIGS. 14 and 19, the power source 70 is operable to detect various power source parameters and transmit one or more signals to fault terminals 500 in the data unit 254 via the control cable 102 when a fault condition exists or an operational limit has been reached. When a fault condition is transmitted to the data unit 254, the data unit 254 provides a signal 284 to the control unit 252 to direct the power source 70 to discontinue supplying power to the induction heating cable 56. Additionally, fault light 290 is illuminated. Power is maintained to the power source 70 when an operational limit signal is transmitted to the data unit 254. However, the fault light 290 on the controller 72 is illuminated. The system may be adapted with an audible alarm, as well. The system 50 may also be adapted with other alarm and indication features. For example, the system 50 may be adapted with a telephone or radio to enable the system to call or page an operator when there is a problem, such as a fault condition.

As best illustrated in FIG. 19, the power source 70 senses a number of operational parameters and provides limit and fault signals to the controller 72 when operation limits or fault limits are exceeded. In addition, the power source 70 is adapted to provide a visual indication of the specific fault or system limit that has been detected. In the illustrated embodiment, the power source 70 utilizes a series of LED's to provide visual indications to assist a user in performing diagnostic checks of the system.

One of the system parameters that is sensed is current source current. A current source limit LED 502 is illuminated when an operational limit is reached in the amount of current being supplied by the power source 70. A current source fault LED 504 is illuminated when a fault limit is reached in the amount of current being supplied by the power source 70. The current source fault LED 504 is set to illuminate at a higher current than the current source limit LED 502. Additionally, signals are sent to the controller 72 to indicate the existence of a fault or limiting condition.

Another system parameters that is sensed is the frequency of the current flowing from the power source 70. Power source indications include an over-frequency limit LED 506 and an over-frequency fault LED 508. The over-frequency limit LED 506 is illuminated when a high-frequency operational limit is reached in the current supplied by the power source 70. The over-frequency fault LED 508 is illuminated when a high-frequency fault limit is reached in the frequency of the current supplied by the power source 70. The over-frequency fault LED 508 is set to illuminate at a higher frequency than the over-frequency limit LED 506. Additional indications include an under-frequency limit LED 510 and an under-frequency fault LED 512. The under-frequency limit LED 510 is illuminated when a low-frequency operational limit is reached in the current supplied by the power source 70. The under-frequency fault LED 512 is illuminated when a low-frequency fault limit is reached in the frequency of the current supplied by the power source 70. The under-frequency fault LED 512 is set to illuminate at a lower frequency than the under-frequency limit LED 510. Additionally, signals are sent to the controller 72 to indicate the existence of an over or under frequency fault or limiting condition.

Still another system parameter that is sensed is reactive current. A current limit LED 513 is illuminated when an operational limit is reached in the amount of reactive current flowing within the power source 70. A current fault LED 514 is illuminated when a fault limit is reached in the amount of reactive current flowing within the power source 70. The current fault LED 514 is set to illuminate for a higher reactive current than the current limit LED 513. Additionally, signals are sent to the controller 72 to indicate the existence of a reactive current fault or limiting condition.

Additionally, the voltage present in the tank circuit formed by the tank capacitor 96 (See FIG. 3) and the induction heating cable 56 is sensed. A tank voltage limit LED 516 is illuminated when an operational limit is reached in the tank voltage. A tank voltage fault LED 518 is illuminated when a fault limit has been reached in the tank voltage. The tank voltage fault LED 518 is set to illuminate at a higher tank voltage than the tank voltage limit LED 516. Additionally, signals are sent to the controller 72 when a tank voltage fault or limit exists.

The line voltage LED 520 illuminates when the line voltage to the power source deviates sufficiently from the expected voltage. The over-temperature LED 522 illuminates when an over temperature condition exists in the power source 70. The load LED 524 illuminates when there is no load or insufficient load is present to couple power to the induction heating cable 56. The ground fault LED 526 illuminates when a ground fault is detected. Fault signals are sent to the controller 72 when the line voltage LED 520, over-temperature LED 522, load LED 524, or ground fault LED 526 is illuminated. Finally, the contactor LED 528 is illuminated when the contactor within the power source 70 is energized by the controller 72.

Figure 20:
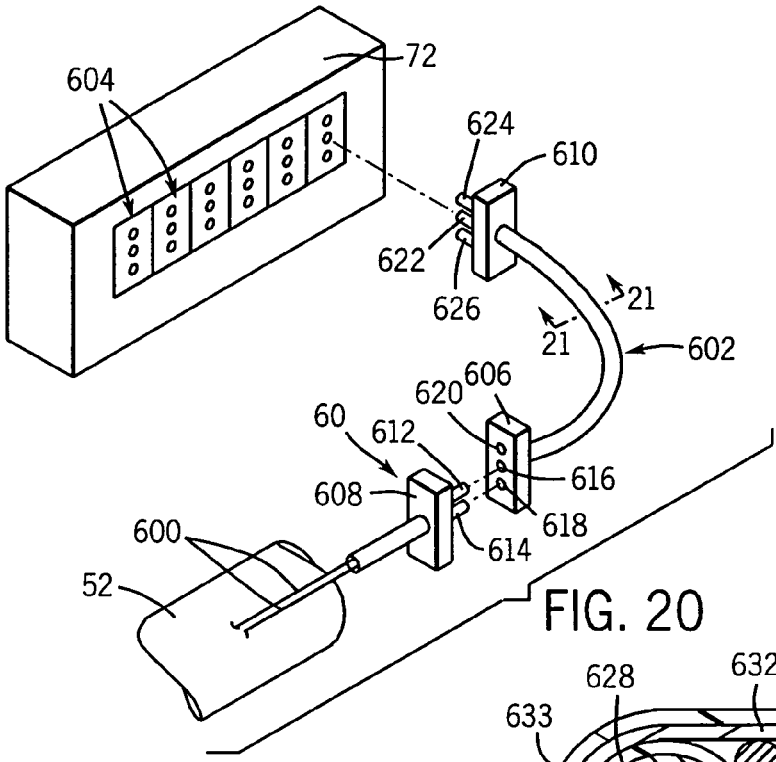
FIG. 20 is a view of a thermocouple connected to a controller by a shielded extension cable.

Referring generally to FIG. 20, the system is adapted to reduce the level of noise in the electrical signals received from a temperature feedback device 60. Typically, the temperature feedback device 60 is a thermocouple. However, other types of temperature feedback devices may be used, such as an RTD (resistance-temperature-detector) bridge circuit. The thermocouple wires 600 may be tack welded onto the workpiece 52 to secure them in position. In the illustrated embodiment, an extension 602 is used to couple the thermocouple wires 600 from the workpiece 52 to one of a plurality of electrical connectors 604 on the rear of the controller 72. In the illustrated embodiment, the extension 602 has a receptacle end 606 that is adapted to matingly engage a connector portion 608 of the thermocouple 60. The extension has a plug end 610 opposite the receptacle end 606 that is adapted to matingly engage one of the electrical connectors 604.

The connector portion 608 of the thermocouple 60 has a positive prong 612 and a negative prong 614. A DC voltage proportional to temperature is produced at the junction of the thermocouple wires 600 and transmitted to the two prongs of the connector portion 608. In the illustrated embodiment, the receptacle end 606 of the extension 602 has three jacks: a positive voltage jack 616, a negative voltage jack 618, and a ground jack 620. The positive voltage jack 616 is adapted to receive the positive prong 612 and the negative voltage jack 618 is adapted to receive the negative prong 614. The plug end 610 of the extension 602 has three prongs: a positive voltage prong 622, a negative voltage prong 624, and a ground prong 626.

Figure 21:
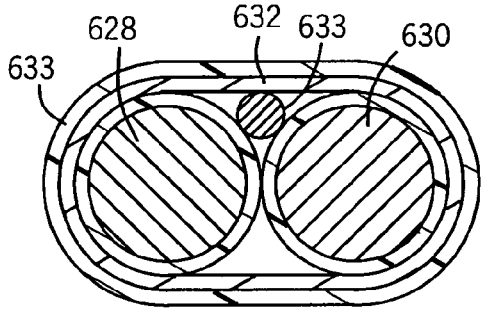
FIG. 21 is a cross-sectional view of the shielded extension cable, taken generally along line 21-21 of FIG. 20.

As best illustrated in FIG. 21, the extension cable 602 has a first insulated conductor 628 and a second insulated conductor 630. The first insulated conductor 628 electrically couples the positive voltage prong 622 to the positive voltage jack 616. The second insulated conductor 630 electrically couples the negative voltage prong 624 to the negative voltage jack 618. A conductive shield 632 surrounds each of the first and second insulated conductors. A drain wire 633 is coupled to the conductive shielding 632. The drain wire 633 electrically couples the ground prong 626 to the ground jack 620. The ground jack 620 of the extension 602 enables the shielding 632 in one extension 602 to be electrically coupled to the shielding 632 in another extension 602 when a plurality of extensions 602 are connected together. Additionally, rather than a separate shielded extension, a thermocouple wire having shielding extending along a portion of its length may also be used. Insulation 633 is provided over the shielding 632.

Referring generally to FIGS. 14 and 20, each electrical connector 604 on the controller 72 has three jacks 258: a positive voltage jack 640, a negative voltage jack 642, and a ground jack 644. When the extension 602 is inserted into the electrical connector 604, the positive voltage prong 622 of the extension 602 is inserted into the positive voltage jack 640 of the electrical connector 604, the negative voltage prong 624 is inserted into the negative voltage jack 642, and the ground prong 626 is inserted into the ground jack 644. When the thermocouple 60 is inserted directly into the electrical connector 604, the positive voltage prong 612 of the thermocouple 600 is inserted into the positive voltage jack 640 of the electrical connector 604 and the negative voltage prong 614 of the thermocouple 600 is inserted into the negative voltage jack 642 of the electrical connector 604.

As best illustrated in FIG. 14, the positive voltage jacks 640 and the negative voltage jack 642 of each of the electrical connectors 604 are electrically coupled through a first ferrite 646 and a second ferrite 648. The first and second ferrites prevent erroneous readings and/or damage to the recorder 260 and control unit 252 due to voltage spikes picked up by the thermocouple 60 or extensions. In addition, each positive voltage jack 640 and each negative voltage jack 642 is electrically coupled to ground 650 through a capacitor 652. The capacitors 652 are selected to have a low impedance to AC signals at noise frequencies. Preferably, the capacitors are selected to have a low impedance at radio frequencies, i.e., the operating frequency of the electricity flowing through the induction heating cable. The low impedance of the capacitors 652 at noise frequencies results in the electrical noise being shunted through the capacitors 652 to ground 650. Thus, the electrical noise does not continue on to the recorder 260 and control unit to interfere with data recordation and control of the system 50. In addition, the capacitors 652 block the DC voltage produced by the thermocouples 60. Thus, the DC voltage from the thermocouples 60 is not shunted to ground 650 but continues on to the recorder 260 and control unit 252. Additionally, each of the ground jacks 644 are electrically coupled to ground 650; thereby grounding the shielding conductor 632. Therefore, any electrical noise picked up by the shielding conductor 632 is electrically coupled to ground 650.

Figure 22:
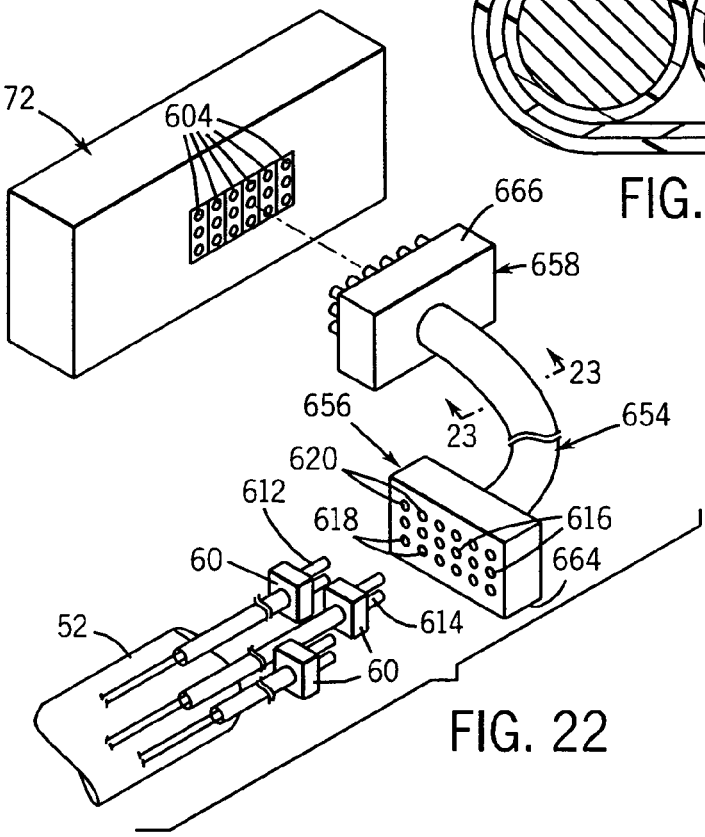
FIG. 22 is a view of a plurality of thermocouples connected to a controller by a shielded multi-thermocouple extension cable.

Referring generally to FIG. 22, in certain applications, the temperature of the workpiece 52 may vary from top to bottom due to convection heat losses. Therefore, a more accurate indication of the temperature of the workpiece 52 may be achieved by placing a number of temperature feedback devices 60 at various locations around the workpiece 52, including the inside of the workpiece 52. In the illustrated embodiment, a multiple extension 654 is used to couple a plurality of temperature feedback devices 60 to the electrical connectors 604 on the rear of the controller 72.

The multiple extension 654 has a female connector assembly 656 at one end that is electrically coupled through the multiple extension 654 to a male connector assembly 658 at the opposite end of the multiple extension 654. The female connector assembly 656 has a plurality of positive voltage jacks 616, negative voltage jacks 618, and ground jacks 620 to enable the multiple extension 654 to electrically couple a plurality of thermocouples 60. The positive voltage jacks 616 are adapted to receive the positive prongs 612 and the negative voltage jacks 618 are adapted to receive the negative prong 614. The male connector assembly 658 has a plurality of positive voltage prongs 622, negative voltage prongs 624, and ground prongs 626 to enable the male connector assembly 658 to connect to a plurality of connector assemblies 604 on the controller 72.

Figure 23:
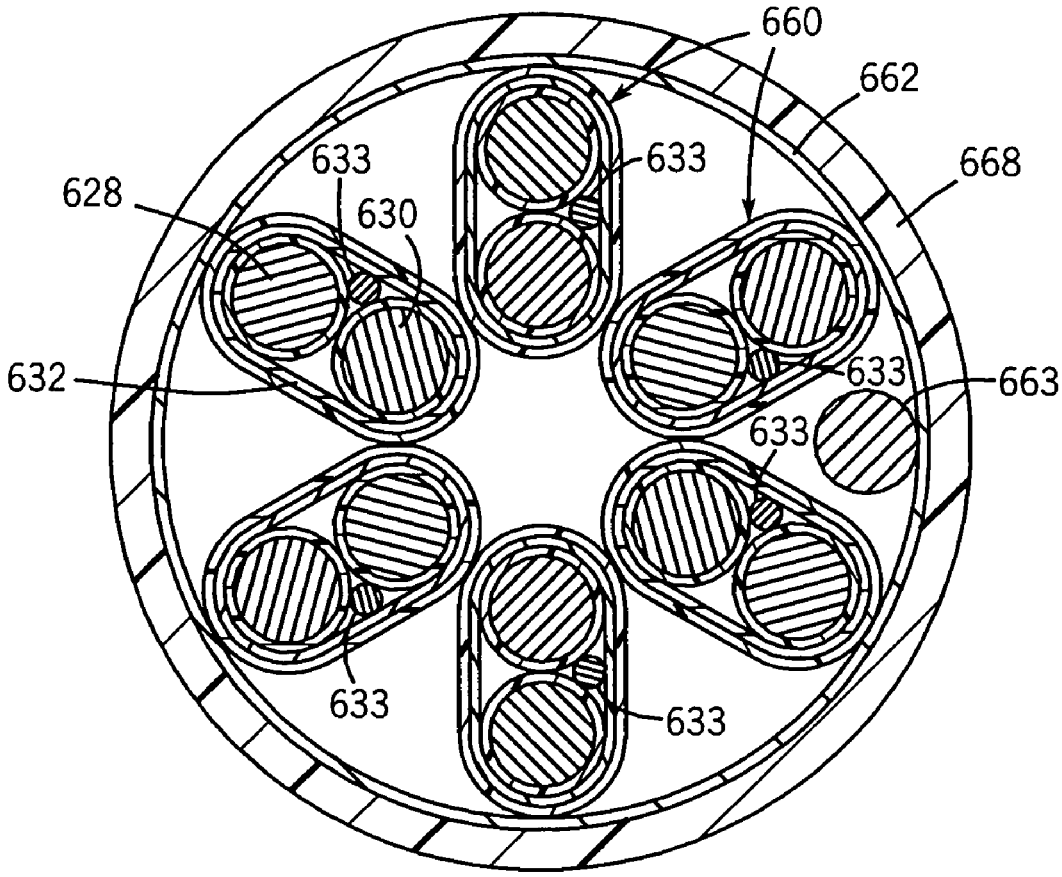
FIG. 23 is a cross-sectional view of the shielded extension multi-thermocouple cable, taken generally along line 23-23 of FIG. 22.

As best illustrated in FIG. 23, the multiple extension 654 has a plurality of sets of insulted conductors 660. In this embodiment, each of the sets of insulted conductors 660 is constructed similarly to the extension cable 602. Each set of insulted conductors electrically couples one temperature feedback device 60 to the controller 72. The shielding 632 in one set of conductors 660 is electrically isolated from the shielding 632 in the other sets of conductors 660 so that noise is not transmitted between the sets of conductors 660. Additionally, in the illustrated embodiment, a separate shielding conductor 662 is wrapped around all of the sets of conductors 660. The separate shielding conductor 662 is electrically coupled to the housing 664 of the female connector assembly 656 and the housing 666 of the male connector assembly 658.

Figure 24:
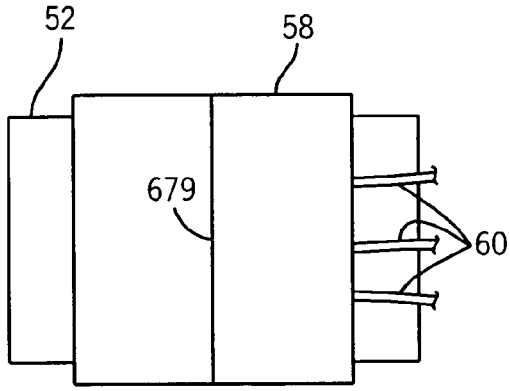
FIG. 24 is a view illustrating the application of thermocouples to a workpiece and the application of a thermal insulation blanket over the workpiece.

Referring generally to FIG. 24, the insulation blanket 58 is placed over the portion of the workpiece 52 to be heated and over any thermocouples 60 that may be placed on the exterior of the workpiece 52 over the region to be heated. The insulation blanket 58 is adapted to insulate the workpiece 52 for heating efficiency and to protect the fluid-cooled induction heating cable 56 from high temperatures. Preferably, the insulation blanket 58 is sized for the specific workpiece to be heated so that the thickness of the insulation is consistent around the workpiece. Inconsistencies in the thickness of the insulation blanket 58 around the workpiece could result in variations in temperature around the workpiece. For example, the insulation blanket 58 may be available in a variety of sizes corresponding to specific pipe diameters. Preferably, the pipe diameter is identified and the insulation blanket 58 corresponding to that pipe diameter is selected. In the illustrated embodiment, the blanket is marked with a centerline 679 to enable the blanket to be easily aligned with a weld joint, or other identifier on a workpiece 52.

Figure 25:
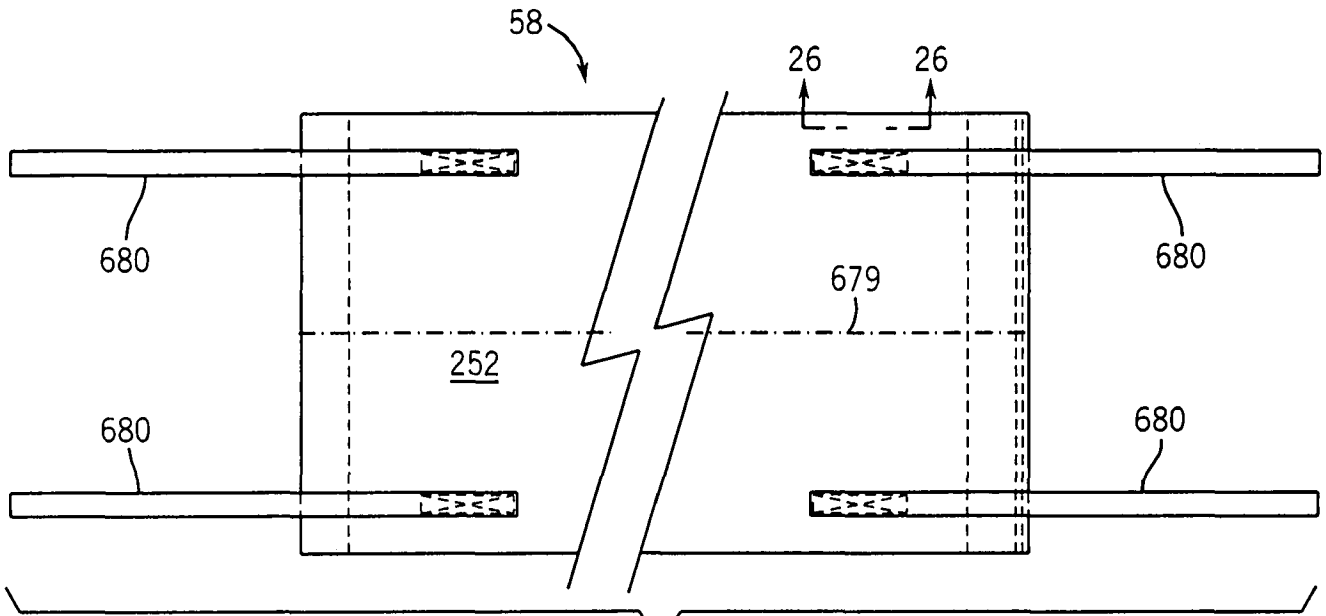
FIG. 25 is an elevational view of an insulation blanket; according to an exemplary embodiment of the present technique.

Referring generally to FIG. 25, in the illustrated embodiment, the insulation blanket 58 has been sized to be wrapped once around a 12-inch diameter pipe with minimal, if any, overlap. Alternatively, the insulation blanket 58 may be adapted to be wrapped more than once around the workpiece with minimal, if any, overlap. In the illustrated embodiment, the insulation blanket has a plurality of high temperature straps 680 that are used to secure the insulation blanket 58 in place around the workpiece 52.

Figure 26:
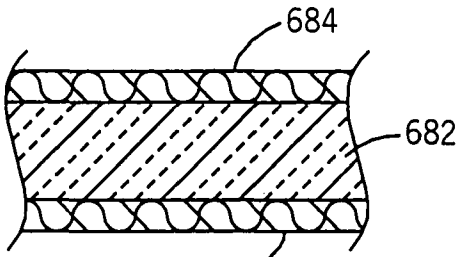
FIG. 26 is a cross-sectional view of a portion of the insulation blanket of FIG. 25, taken generally along line 26-26 of FIG. 25.

As best illustrated in FIG. 26, the insulation blanket 58 comprises an insulation mat 682 sewn into a woven silica fabric 684. In the illustrated embodiment, the insulation mat 682 is made from continuous filament silica fiber. The high temperature straps also are made of woven silica and sewn onto the silica blanket for easy attachment to the workpiece. The silica material has a continuous use temperature rating of over 2000 deg. F. with a melting point of 3000 deg. F. Additionally, the insulation mat 682 and silica blanket 684 markedly reduce the temperature to which the fluid-cooled induction heating cable 52 is exposed. For example, a ½-inch thick insulation blanket 58 exposed, on its hot side, to a workpiece temperature of 1840° F., will have a cold-side temperature of approximately 298° F. after 2 hours, a temperature difference of 1542° F. Furthermore, the insulation mat 682 and silica blanket 684 provide the insulation blanket 58 greater durability, enabling the insulation blanket 58 to be reused several times, e.g., up to 50 times. Additionally, the silica blanket 684 reduces the insulation dust and particulate that is associated with bulk insulation materials.

Figure 27:
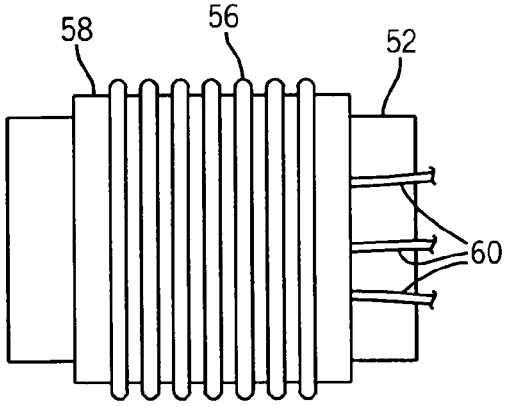
FIG. 27 is an elevational view illustrating the wrapping of a fluid-cooled induction heating cable around a workpiece to form an inductive coil, according to an exemplary embodiment of the present technique.

Referring generally to FIG. 27, the fluid-cooled heating cable 56 is to enable the heating cable 56 to be wrapped around the workpiece 52 to form the coils of an inductor. The insulation blanket 58 and the cooling fluid 104 flowing through the fluid-cooled induction heating cable 56 maintain the heating cable 56 cool to the touch. Thus, if the temperature information from the thermocouple 60 indicates that a region of the workpiece 52 is not at the proper temperature, the fluid-cooled heating cable 56 may be moved by hand into a better orientation relative to the workpiece 52 to achieve temperature uniformity of the workpiece 52.

Figure 28:
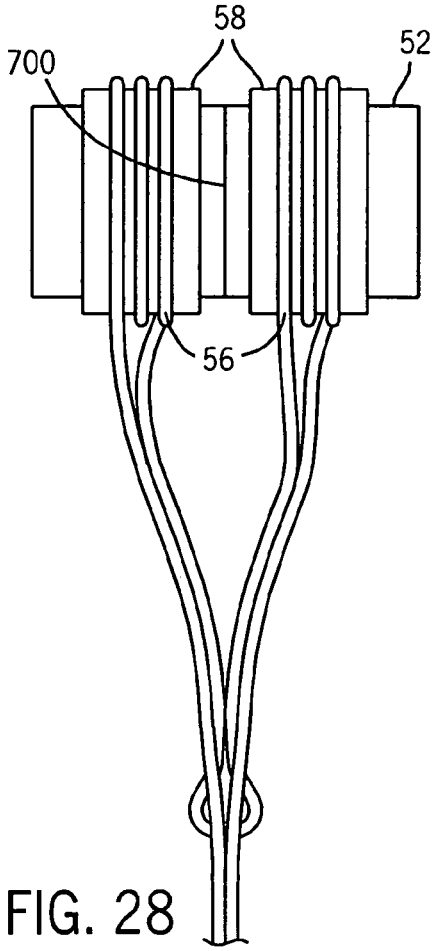
FIG. 28 is an elevational view illustrating the wrapping of a fluid-cooled induction heating cable around a workpiece on opposite sides of a weld area, according to an alternative embodiment of the present technique.

Referring generally to FIG. 28, the portable induction heating system enables a weld area to be pre-heated prior to welding and then heat-treated after welding to relieve stress in the weld 700. The heating cable may be wrapped around a first region of the workpiece 52 to form a first set of coils and then routed to a second region of the workpiece 52 to form a second set of coils. This arrangement enables the area 701 adjacent to the weld 700, an uncovered third region of the workpiece between the first and second regions, to be heated, yet still remain accessible so that the workpieces 52 may be welded shortly after pre-heating. In fact, the workpieces also may be heated during welding. Additional induction heating cables 56 may be coupled together to provide sufficient length.

Figure 29:
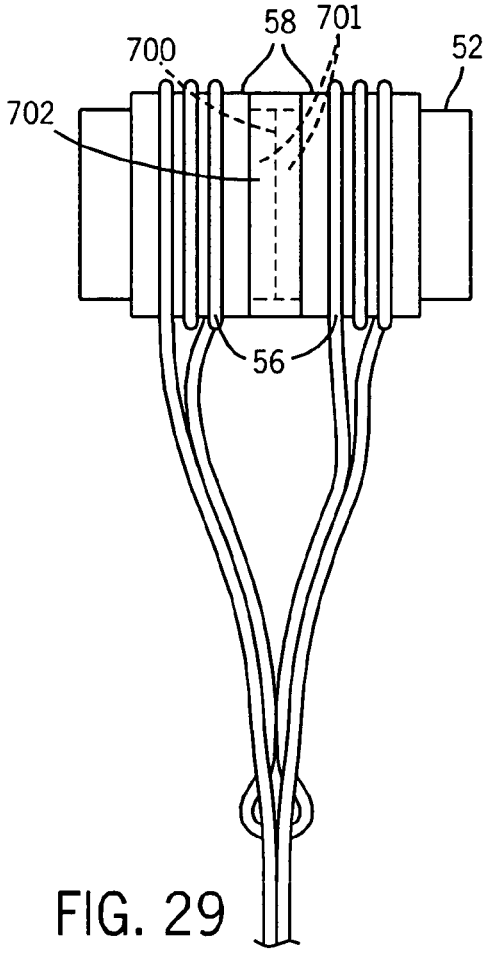
FIG. 29 is an elevational view illustrating the placement of an insulation blanket over the weld area to retain heat in the weld area during post-weld induction heating of the weld area, according to an alternative embodiment of the present technique.
Figure 35:
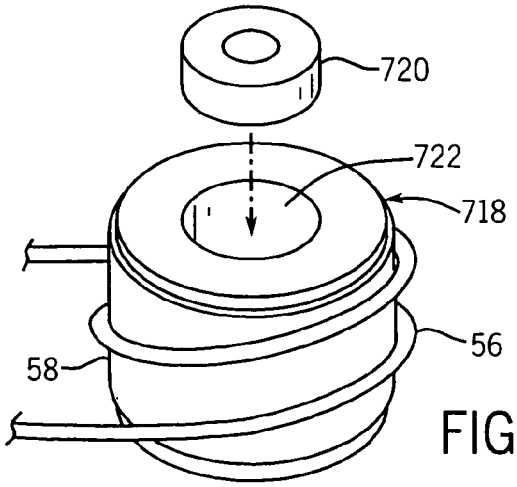
FIG. 35 is an elevational view illustrating the use of a portable induction heating system to shrink fit a bearing and bushing, according to an exemplary embodiment of the present invention.

Referring generally to FIG. 29, the portable induction heating system may then be operated to perform a hydrogen bake-out of the weld 700. An additional piece 702 of thermal insulation is placed over the weld 700 after welding is complete. The workpiece is inductively heated to drive hydrogen from the weld 700. The additional piece of thermal insulation 702 enables a higher temperature to be reached in the area 701 adjacent to the weld 700 by minimizing radiation heat losses.

Figure 30:
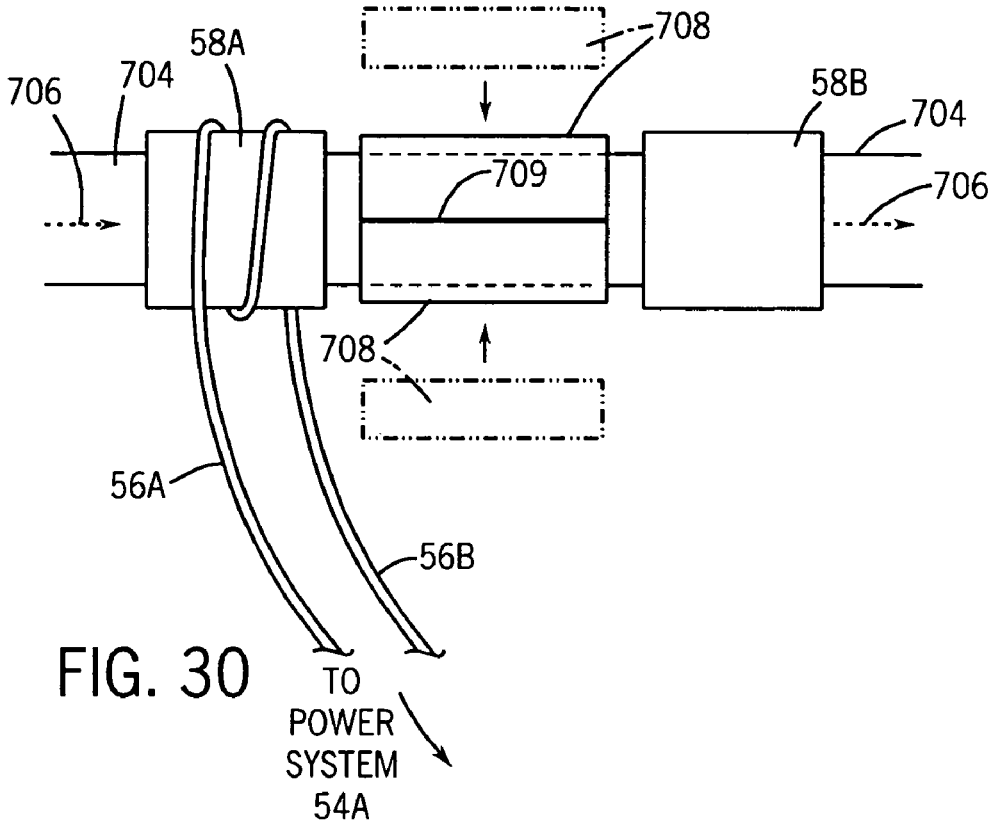

Referring generally to FIGS. 30-32, portable induction systems 50 enable a pipeline 704 to be reworked without requiring the flow of fluid 706 within the pipeline 704 to be stopped. For pipelines, the affected areas must typically be pre-heated prior to welding. The fluid 706 in the pipeline 704 will carry heat away from the pipeline 704, complicating the process of pre-heating the area. This is especially true for resistive heating systems which themselves get extremely hot and must be allowed to cool before removal. Additionally, resistive heating systems require large amounts of insulation to prevent heat loss and to protect workers.

As best illustrated in FIG. 30, a section of the pipeline 704 is to be repaired by welding two semi-cylindrical repair pieces 708 to each other and then to the pipeline 704. The two repair pieces 708 are placed around the pipeline 704 and welded together by longitudinal welds 709.

The repair pieces 708 are secured to the pipeline by a girth weld at each end. As illustrated in FIG. 31, one flexible induction heating cable 56A from one portable power system 54A is wrapped around the pipeline adjacent to the left end of the repair pieces 708 and a second flexible induction heating cable 56B from a second power system 54B is wrapped around the repair pieces 708 adjacent to the left end of the repair pieces 708. The two portable inductive heating systems 54A and 54B are used to heat the pipeline 704 and repair pieces 708, before, during, and/or after welding of the left most girth weld 700A.

As illustrated in FIG. 32, the flexible induction heating cables 56A and 56B are then repositioned to heat the pipeline 704 and repair pieces 708 before, during, or after welding of the rightmost girth weld 700B. The flexible induction heating cables 56 may be repositioned quickly because the induction heating cables 56 remain cool to the touch.

Figure 33:
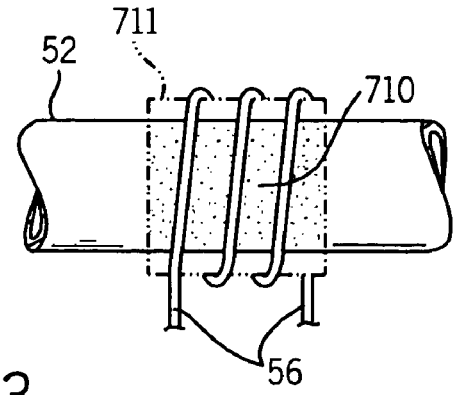
FIG. 33 is an elevational view illustrating the curing of a layer of temperature sensitive material using a portable induction heating system to inductively heat a the workpiece and layer, according to an exemplary embodiment of the present invention.

Referring generally to FIG. 33, the portable induction heating system 50 also enables a workpiece 52 to be heated on-site to activate temperature sensitive layers 710 that may be deposited on the workpiece, such as to cure a layer of epoxy on the workpiece, to set a layer of thermosetting plastic, etc. In the illustrated embodiment, a portion of the workpiece 52 is inductively heated using the portable induction heating system 50. The heat in the workpiece 52 activates the temperature sensitive layer 710. The flexible induction heating cable 56 may be wrapped around a frame or tube 711 surrounding the workpiece so that the flexible induction heating cable does not contact the workpiece. In this example, the programmable controller may be programmed to enable the workpiece 52 to be heated at a controlled rate and to a specific desired temperature to establish optimal conditions for activating the temperature sensitive layer 710.

Referring generally to FIG. 34, hydraulic shafts 712 typically are polished, waxed, and buffed. Wax 713 is applied to the shaft 712 and the shaft 712 is rotated, as represented by the arrow 714. A buffer 716 is passed back along the shaft to buff the wax. In the illustrated embodiment, a flexible induction heating cable 56 from a portable induction system 50 is wrapped around an axially moveable frame 717. The buffer 716 and frame 717 are moved axially along the shaft 712, as represented by the arrow. In the illustrated embodiment, a portion of the shaft 712 just ahead of the buffer 716 is heated just prior to buffing with the buffer 716. This enables the each portion of the shaft 712 and wax 713 to be inductively heated just prior to buffing with the buffer 716, reducing the number of passes of the buffer 714 for buffing the shaft 712 to one pass.

Referring generally to FIG. 34, the portable induction heating system 50 also may be used in shrink fitting one object to another. In the illustrated embodiment, the induction heating cable 56 has been wrapped around a bushing 718. At ambient temperature, a bearing 720 cannot be inserted into a hole 722 in the bushing 718. The portable induction heating system is operated to heat the bushing 718 so that the hole 722 expands so that the bearing 720 may be inserted into the hole 722. As the heat is removed, the bushing 718 cools and contracts, securing the bearing 720 within the bushing 720.

It will be understood that the foregoing description is of preferred exemplary embodiments of this invention, and that the invention is not limited to the specific forms shown. For example, the various induction heating operations discussed above is not intended to be an exclusive list of portable induction heating system operations. The portable induction heating system may be configured to inductively heat a workpiece to perform a myriad of different heating operations. In addition, the induction heating cable may be arranged in many different physical arrangements around a workpiece. Additionally, the portable induction heating system may be operated to heat a workpiece according to an almost infinite number of different temperature profiles. These and other modifications may be made in the design and arrangement of the elements without departing from the scope of the invention as expressed in the appended claims.

What is claimed is:

1. A portable heating system, comprising in a portable unit:

a power source operable to apply output power to an electrical pathway to inductively heat a workpiece, wherein the electrical pathway includes an induction heating cable adjacent the workpiece, a supply path from the portable heating system to the induction heating cable, and a return path from the induction heating cable to the portable heating system;

a power source controller operable to control the heating of a workpiece in response to programming instructions provided by a user to produce a desired temperature profile in the workpiece;

a cart operable to transport the power source and power source controller to the workpiece;

a cooling unit operable to provide a flow of cooling fluid, the cooling unit being disposed on the cart; and the induction heating cable, wherein the induction heating cable is a fluid-cooled induction heating cable that cooperates with the cooling unit to form at least a portion of a single cooling pathway that is configured to generally extend along the supply path and the return path of the electrical pathway to remove heat therefrom.

2. The system as recited in claim 1, comprising a temperature feedback device operable to produce a signal representative of workpiece temperature to the power source controller.

3. The system as recited in claim 1, wherein the power source controller uses PID control.

4. The system as recited in claim 1, wherein the power source controller uses PI control.

5. The system as recited in claim 1, wherein the system is operable to raise the temperature of a workpiece to a first temperature and lower the temperature of the workpiece from the first temperature to a second temperature at a desired rate.

6. The system as recited in claim 1, comprising an insulation blanket having a visible line to enable the insulation blanket to be aligned with a weld joint.

* * * * *